US007311762B2

(12) United States Patent
Taylor et al.

(10) Patent No.: US 7,311,762 B2
(45) Date of Patent: Dec. 25, 2007

(54) AIR CONDITIONER DEVICE WITH A REMOVABLE DRIVER ELECTRODE

(75) Inventors: Charles E. Taylor, Punta Gorda, FL (US); Andrew J. Parker, Novato, CA (US); Igor Y. Botvinnik, Novato, CA (US); Shek Fai Lau, Foster City, CA (US); Gregory S. Snyder, Novato, CA (US); John Paul Reeves, Hong Kong (CN)

(73) Assignee: Sharper Image Corporation, San Francisco, CA (US)

( * ) Notice: Subject to any disclaimer, the term of this patent is extended or adjusted under 35 U.S.C. 154(b) by 6 days.

(21) Appl. No.: 11/188,478

(22) Filed: Jul. 25, 2005

(65) Prior Publication Data

US 2006/0021509 A1 Feb. 2, 2006

Related U.S. Application Data

(60) Provisional application No. 60/590,960, filed on Jul. 23, 2004.

(51) Int. Cl.
*B03C 3/74* (2006.01)

(52) U.S. Cl. ..... 96/39; 96/51; 96/94; 422/186.04

(58) Field of Classification Search ..... 96/29, 96/39–42, 51, 94, 96, 97; 95/74–77; 455/186.04
See application file for complete search history.

(56) References Cited

U.S. PATENT DOCUMENTS

| | | | | |
|---|---|---|---|---|
| 653,421 | A | | 7/1900 | Lorey |
| 895,729 | A | | 8/1908 | Carlborg |
| 995,958 | A | | 6/1911 | Goldberg |
| 1,791,338 | A | | 2/1931 | Wintermute |
| 1,869,335 | A | | 7/1932 | Day |
| 1,882,949 | A | | 10/1932 | Ruder |
| 2,129,783 | A | | 9/1938 | Penney |
| 2,247,409 | A | | 7/1941 | Roper |
| 2,327,588 | A | | 8/1943 | Bennett |
| 2,359,057 | A | | 9/1944 | Skinner |
| 2,509,548 | A | | 5/1950 | White |
| 2,590,447 | A | | 3/1952 | Nord et al. |
| 2,949,550 | A | | 8/1960 | Brown |
| 2,978,066 | A | * | 4/1961 | Nodolf ..... 96/87 |
| 3,018,394 | A | | 1/1962 | Brown |
| 3,026,964 | A | | 3/1962 | Penney |
| 3,374,941 | A | | 3/1968 | Okress |
| 3,412,530 | A | | 11/1968 | Cardiff |
| 3,518,462 | A | | 6/1970 | Brown |

(Continued)

FOREIGN PATENT DOCUMENTS

| | | |
|---|---|---|
| CN | 2111112 U | 7/1972 |

(Continued)

*Primary Examiner*—Richard L. Chiesa
(74) *Attorney, Agent, or Firm*—Bell, Boyd & Lloyd LLP

(57) ABSTRACT

An air-conditioning device including a housing having at least one grill, an electrode assembly and a driver electrode. Both the electrode assembly and the driver electrode are supported by the housing. The electrode assembly includes a portion that is removable from the housing, and the driver electrode is removable from the housing independent from the removable portion of the electrode assembly.

23 Claims, 12 Drawing Sheets

U.S. PATENT DOCUMENTS

| | | | | |
|---|---|---|---|---|
| 3,540,191 | A | | 11/1970 | Herman |
| 3,581,470 | A | | 6/1971 | Aitkenhead et al. |
| 3,638,058 | A | | 1/1972 | Fritzius |
| 3,744,216 | A | | 7/1973 | Halloran |
| 3,806,763 | A | | 4/1974 | Masuda |
| 3,892,927 | A | | 7/1975 | Lindenberg |
| 3,945,813 | A | | 3/1976 | Iinoya et al. |
| 3,958,960 | A | | 5/1976 | Bakke |
| 3,958,961 | A | | 5/1976 | Bakke |
| 3,958,962 | A | | 5/1976 | Hayashi |
| 3,981,695 | A | | 9/1976 | Fuchs |
| 3,984,215 | A | | 10/1976 | Zucker |
| 3,988,131 | A | | 10/1976 | Kanazawa et al. |
| 4,007,024 | A | | 2/1977 | Sallee et al. |
| 4,052,177 | A | | 10/1977 | Kide |
| 4,056,372 | A | | 11/1977 | Hayashi |
| 4,070,163 | A | | 1/1978 | Kolb et al. |
| 4,074,983 | A | | 2/1978 | Bakke |
| 4,092,134 | A | | 5/1978 | Kikuchi |
| 4,097,252 | A | | 6/1978 | Kirchhoff et al. |
| 4,102,654 | A | | 7/1978 | Pellin |
| 4,104,042 | A | | 8/1978 | Brozenick |
| 4,110,086 | A | | 8/1978 | Schwab et al. |
| 4,119,415 | A | | 10/1978 | Hayashi et al. |
| 4,126,434 | A | | 11/1978 | Keiichi |
| 4,138,233 | A | | 2/1979 | Masuda |
| 4,147,522 | A | | 4/1979 | Gonas et al. |
| 4,155,792 | A | | 5/1979 | Gelhaar et al. |
| 4,171,975 | A | | 10/1979 | Kato et al. |
| 4,185,971 | A | | 1/1980 | Isahaya |
| 4,189,308 | A | | 2/1980 | Feldman |
| 4,205,969 | A | | 6/1980 | Matsumoto |
| 4,209,306 | A | | 6/1980 | Feldman et al. |
| 4,218,225 | A | | 8/1980 | Kirchhoff et al. |
| 4,225,323 | A | | 9/1980 | Zarchy et al. |
| 4,227,894 | A | | 10/1980 | Proynoff |
| 4,231,766 | A | | 11/1980 | Spurgin |
| 4,232,355 | A | | 11/1980 | Finger et al. |
| 4,244,710 | A | | 1/1981 | Burger |
| 4,244,712 | A | | 1/1981 | Tongret |
| 4,251,234 | A | | 2/1981 | Chang |
| 4,253,852 | A | | 3/1981 | Adams |
| 4,259,093 | A | | 3/1981 | Vlastos et al. |
| 4,259,452 | A | | 3/1981 | Yukuta et al. |
| 4,259,707 | A | | 3/1981 | Penney |
| 4,264,343 | A | * | 4/1981 | Natarajan et al. ..... 96/48 |
| 4,266,948 | A | | 5/1981 | Teague et al. |
| 4,282,014 | A | | 8/1981 | Winkler et al. |
| 4,284,420 | A | | 8/1981 | Borysiak |
| 4,289,504 | A | | 9/1981 | Scholes |
| 4,293,319 | A | | 10/1981 | Claassen, Jr. |
| 4,308,036 | A | | 12/1981 | Zahedi et al. |
| 4,315,188 | A | | 2/1982 | Cerny et al. |
| 4,318,718 | A | | 3/1982 | Utsumi et al. |
| 4,338,560 | A | | 7/1982 | Lemley |
| 4,342,571 | A | | 8/1982 | Hayashi |
| 4,349,359 | A | | 9/1982 | Fitch et al. |
| 4,351,648 | A | | 9/1982 | Penney |
| 4,354,861 | A | | 10/1982 | Kalt |
| 4,357,150 | A | | 11/1982 | Masuda et al. |
| 4,362,632 | A | | 12/1982 | Jacob |
| 4,363,072 | A | | 12/1982 | Coggins |
| 4,366,525 | A | | 12/1982 | Baumgartner |
| 4,369,776 | A | | 1/1983 | Roberts |
| 4,375,364 | A | | 3/1983 | Van Hoesen et al. |
| 4,380,900 | A | | 4/1983 | Linder et al. |
| 4,386,395 | A | | 5/1983 | Francis, Jr. |
| 4,391,614 | A | | 7/1983 | Rozmus |
| 4,394,239 | A | | 7/1983 | Kitzelmann et al. |
| 4,405,342 | A | | 9/1983 | Bergman |
| 4,406,671 | A | | 9/1983 | Rozmus |
| 4,412,850 | A | | 11/1983 | Kurata et al. |
| 4,413,225 | A | | 11/1983 | Donig et al. |
| 4,414,603 | A | | 11/1983 | Masuda |
| 4,435,190 | A | | 3/1984 | Taillet et al. |
| 4,440,552 | A | | 4/1984 | Uchiya et al. |
| 4,443,234 | A | | 4/1984 | Carlsson |
| 4,445,911 | A | | 5/1984 | Lind |
| 4,477,263 | A | | 10/1984 | Shaver et al. |
| 4,477,268 | A | | 10/1984 | Kalt |
| 4,481,017 | A | | 11/1984 | Furlong |
| 4,496,375 | A | | 1/1985 | Levantine |
| 4,502,002 | A | | 2/1985 | Ando |
| 4,505,724 | A | | 3/1985 | Baab |
| 4,509,958 | A | | 4/1985 | Masuda et al. |
| 4,514,780 | A | | 4/1985 | Brussee et al. |
| 4,515,982 | A | | 5/1985 | Lechtken et al. |
| 4,516,991 | A | | 5/1985 | Kawashima |
| 4,521,229 | A | | 6/1985 | Baker et al. |
| 4,522,634 | A | | 6/1985 | Frank |
| 4,534,776 | A | | 8/1985 | Mammel et al. |
| 4,536,698 | A | | 8/1985 | Shevalenko et al. |
| 4,544,382 | A | | 10/1985 | Taillet et al. |
| 4,555,252 | A | | 11/1985 | Eckstein |
| 4,569,684 | A | | 2/1986 | Ibbott |
| 4,582,961 | A | | 4/1986 | Frederiksen |
| 4,587,475 | A | | 5/1986 | Finney, Jr. et al. |
| 4,588,423 | A | | 5/1986 | Gillingham et al. |
| 4,590,042 | A | | 5/1986 | Drage |
| 4,597,780 | A | | 7/1986 | Reif |
| 4,597,781 | A | | 7/1986 | Spector |
| 4,600,411 | A | | 7/1986 | Santamaria |
| 4,601,733 | A | | 7/1986 | Ordines et al. |
| 4,604,174 | A | | 8/1986 | Bollinger et al. |
| 4,614,573 | A | | 9/1986 | Masuda |
| 4,623,365 | A | | 11/1986 | Bergman |
| 4,626,261 | A | | 12/1986 | Jorgensen |
| 4,632,135 | A | | 12/1986 | Lenting et al. |
| 4,632,746 | A | | 12/1986 | Bergman |
| 4,636,981 | A | | 1/1987 | Ogura |
| 4,643,744 | A | | 2/1987 | Brooks |
| 4,643,745 | A | | 2/1987 | Sakakibara et al. |
| 4,647,836 | A | | 3/1987 | Olsen |
| 4,650,648 | A | | 3/1987 | Beer et al. |
| 4,656,010 | A | | 4/1987 | Leitzke et al. |
| 4,657,738 | A | | 4/1987 | Kanter et al. |
| 4,659,342 | A | | 4/1987 | Lind |
| 4,662,903 | A | | 5/1987 | Yanagawa |
| 4,666,474 | A | | 5/1987 | Cook |
| 4,668,479 | A | | 5/1987 | Manabe et al. |
| 4,670,026 | A | | 6/1987 | Hoenig |
| 4,673,416 | A | | 6/1987 | Sakakibara et al. |
| 4,674,003 | A | | 6/1987 | Zylka |
| 4,680,496 | A | | 7/1987 | Letournel et al. |
| 4,686,370 | A | | 8/1987 | Blach |
| 4,689,056 | A | | 8/1987 | Noguchi et al. |
| 4,691,829 | A | | 9/1987 | Auer |
| 4,692,174 | A | | 9/1987 | Gelfand et al. |
| 4,693,869 | A | | 9/1987 | Pfaff |
| 4,694,376 | A | | 9/1987 | Gesslauer |
| 4,702,752 | A | | 10/1987 | Yanagawa |
| 4,713,092 | A | | 12/1987 | Kikuchi et al. |
| 4,713,093 | A | | 12/1987 | Hansson |
| 4,713,724 | A | | 12/1987 | Voelkel |
| 4,715,870 | A | | 12/1987 | Masuda et al. |
| 4,725,289 | A | | 2/1988 | Quintilian |
| 4,726,812 | A | | 2/1988 | Hirth |
| 4,726,814 | A | | 2/1988 | Weitman |
| 4,736,127 | A | | 4/1988 | Jacobsen |
| 4,743,275 | A | | 5/1988 | Flanagan |
| 4,749,390 | A | | 6/1988 | Burnett et al. |
| 4,750,921 | A | | 6/1988 | Sugita et al. |
| 4,760,302 | A | | 7/1988 | Jacobsen |
| 4,760,303 | A | | 7/1988 | Miyake |

4,765,802 A 8/1988 Gombos et al.
4,771,361 A 9/1988 Varga
4,772,297 A 9/1988 Anzai
4,779,182 A 10/1988 Mickal et al.
4,781,736 A 11/1988 Cheney et al.
4,786,844 A 11/1988 Farrell et al.
4,789,801 A * 12/1988 Lee ..... 310/308
4,808,200 A 2/1989 Dallhammer et al.
4,811,159 A 3/1989 Foster, Jr.
4,822,381 A 4/1989 Mosley et al.
4,853,005 A 8/1989 Jaisinghani et al.
4,869,736 A 9/1989 Ivester et al.
4,892,713 A 1/1990 Newman
4,929,139 A 5/1990 Vorreiter et al.
4,940,470 A 7/1990 Jaisinghani et al.
4,940,894 A 7/1990 Morters
4,941,068 A 7/1990 Hofmann
4,941,224 A 7/1990 Saeki et al.
4,944,778 A 7/1990 Yanagawa
4,954,320 A 9/1990 Birmingham et al.
4,955,991 A 9/1990 Torok et al.
4,966,666 A 10/1990 Waltonen
4,967,119 A 10/1990 Torok et al.
4,976,752 A 12/1990 Torok et al.
4,978,372 A 12/1990 Pick
D315,598 S 3/1991 Yamamoto et al.
5,003,774 A 4/1991 Leonard
5,006,761 A 4/1991 Torok et al.
5,010,869 A 4/1991 Lee
5,012,093 A 4/1991 Shimizu
5,012,094 A 4/1991 Hamade
5,012,159 A 4/1991 Torok et al.
5,022,979 A 6/1991 Hijikata et al.
5,024,685 A 6/1991 Torok et al.
5,030,254 A 7/1991 Heyen et al.
5,034,033 A 7/1991 Alsup et al.
5,037,456 A 8/1991 Yu
5,045,095 A 9/1991 You
5,053,912 A 10/1991 Loreth et al.
5,059,219 A 10/1991 Plaks et al.
5,061,462 A 10/1991 Suzuki
5,066,313 A 11/1991 Mallory, Sr.
5,072,746 A 12/1991 Kantor
5,076,820 A 12/1991 Gurvitz
5,077,468 A 12/1991 Hamade
5,077,500 A 12/1991 Torok et al.
5,100,440 A 3/1992 Stahel et al.
RE33,927 E 5/1992 Fuzimura
D326,514 S 5/1992 Alsup et al.
5,118,942 A 6/1992 Hamade
5,125,936 A 6/1992 Johansson
5,136,461 A 8/1992 Zellweger
5,137,546 A 8/1992 Steinbacher et al.
5,141,529 A 8/1992 Oakley et al.
5,141,715 A 8/1992 Sackinger et al.
D329,284 S 9/1992 Patton
5,147,429 A 9/1992 Bartholomew et al.
5,154,733 A 10/1992 Fujii et al.
5,158,580 A 10/1992 Chang
D332,655 S 1/1993 Lytle et al.
5,180,404 A 1/1993 Loreth et al.
5,183,480 A 2/1993 Raterman et al.
5,196,171 A 3/1993 Peltier
5,198,003 A 3/1993 Haynes
5,199,257 A 4/1993 Colletta et al.
5,210,678 A 5/1993 Lain et al.
5,215,558 A 6/1993 Moon
5,217,504 A 6/1993 Johansson
5,217,511 A 6/1993 Plaks et al.
5,234,555 A 8/1993 Ibbott
5,248,324 A 9/1993 Hara
5,250,267 A 10/1993 Johnson et al.
5,254,155 A 10/1993 Mensi
5,266,004 A 11/1993 Tsumurai et al.
5,271,763 A 12/1993 Jang
5,282,891 A 2/1994 Durham
5,290,343 A 3/1994 Morita et al.
5,296,019 A 3/1994 Oakley et al.
5,302,190 A 4/1994 Williams
5,308,586 A 5/1994 Fritsche et al.
5,315,838 A 5/1994 Thompson
5,316,741 A 5/1994 Sewell et al.
5,330,559 A 7/1994 Cheney et al.
5,348,571 A 9/1994 Weber
5,376,168 A 12/1994 Inculet
5,378,978 A 1/1995 Gallo et al.
5,386,839 A 2/1995 Chen
5,395,430 A 3/1995 Lundgren et al.
5,401,301 A 3/1995 Schulmerich et al.
5,401,302 A 3/1995 Schulmerich et al.
5,403,383 A 4/1995 Jaisinghani
5,405,434 A 4/1995 Inculet
5,407,469 A 4/1995 Sun
5,407,639 A 4/1995 Watanabe et al.
5,417,936 A 5/1995 Suzuki et al.
5,419,953 A 5/1995 Chapman
5,433,772 A 7/1995 Sikora
5,435,817 A 7/1995 Davis et al.
5,435,978 A 7/1995 Yokomi
5,437,713 A 8/1995 Chang
5,437,843 A 8/1995 Kuan
5,445,798 A 8/1995 Ikeda et al.
5,466,279 A 11/1995 Hattori et al.
5,468,454 A 11/1995 Kim
5,474,599 A 12/1995 Cheney et al.
5,484,472 A 1/1996 Weinberg
5,484,473 A 1/1996 Bontempi
5,492,678 A 2/1996 Ota et al.
5,501,844 A 3/1996 Kasting, Jr. et al.
5,503,808 A 4/1996 Garbutt et al.
5,503,809 A 4/1996 Coate et al.
5,505,914 A 4/1996 Tona-Serra
5,508,008 A 4/1996 Wasser
5,514,345 A 5/1996 Garbutt et al.
5,516,493 A 5/1996 Bell et al.
5,518,531 A 5/1996 Joannu
5,520,887 A 5/1996 Shimizu et al.
5,525,310 A 6/1996 Decker et al.
5,529,613 A 6/1996 Yavnieli
5,529,760 A 6/1996 Burris
5,532,798 A 7/1996 Nakagami et al.
5,535,089 A 7/1996 Ford et al.
5,536,477 A 7/1996 Cha et al.
5,538,695 A 7/1996 Shinjo et al.
5,540,761 A 7/1996 Yamamoto
5,542,967 A 8/1996 Ponizovsky et al.
5,545,379 A 8/1996 Gray
5,545,380 A 8/1996 Gray
5,547,643 A 8/1996 Nomoto et al.
5,549,874 A 8/1996 Kamiya et al.
5,554,344 A 9/1996 Duarte
5,554,345 A 9/1996 Kitchenman
5,565,685 A 10/1996 Czako et al.
5,569,368 A 10/1996 Larsky et al.
5,569,437 A 10/1996 Stiehl et al.
D375,546 S 11/1996 Lee
5,571,483 A 11/1996 Pfingstl et al.
5,573,577 A 11/1996 Joannou
5,573,730 A 11/1996 Gillum
5,578,112 A 11/1996 Krause
5,578,280 A 11/1996 Kazi et al.
5,582,632 A 12/1996 Nohr et al.
5,587,131 A 12/1996 Malkin et al.
D377,523 S 1/1997 Marvin et al.
5,591,253 A 1/1997 Altman et al.
5,591,334 A 1/1997 Shimizu et al.

5,591,412 A 1/1997 Jones et al.
5,593,476 A 1/1997 Coppom
5,601,636 A 2/1997 Glucksman
5,603,752 A 2/1997 Hara
5,603,893 A 2/1997 Gundersen et al.
5,614,002 A 3/1997 Chen
5,624,476 A 4/1997 Eyraud
5,630,866 A 5/1997 Gregg
5,630,990 A 5/1997 Conrad et al.
5,637,198 A 6/1997 Breault
5,637,279 A 6/1997 Besen et al.
5,641,342 A 6/1997 Smith et al.
5,641,461 A 6/1997 Ferone
5,647,890 A 7/1997 Yamamoto
5,648,049 A 7/1997 Jones et al.
5,655,210 A 8/1997 Gregoire et al.
5,656,063 A 8/1997 Hsu
5,665,147 A 9/1997 Taylor et al.
5,667,563 A 9/1997 Silva, Jr.
5,667,564 A 9/1997 Weinberg
5,667,565 A 9/1997 Gondar
5,667,756 A 9/1997 Ho
5,669,963 A 9/1997 Horton et al.
5,678,237 A 10/1997 Powell et al.
5,681,434 A 10/1997 Eastlund
5,681,533 A 10/1997 Hiromi
5,698,164 A 12/1997 Kishioka et al.
5,702,507 A 12/1997 Wang
D389,567 S 1/1998 Gudefin
5,766,318 A 6/1998 Loreth et al.
5,779,769 A 7/1998 Jiang
5,785,631 A 7/1998 Heidecke
5,814,135 A 9/1998 Weinberg
5,879,435 A 3/1999 Satyapal et al.
5,893,977 A 4/1999 Pucci
5,911,957 A 6/1999 Khatchatrian et al.
5,972,076 A 10/1999 Nichols et al.
5,975,090 A 11/1999 Taylor et al.
5,980,614 A 11/1999 Loreth et al.
5,993,521 A 11/1999 Loreth et al.
5,993,738 A 11/1999 Goswani
5,997,619 A 12/1999 Knuth et al.
6,019,815 A 2/2000 Satyapal et al.
6,042,637 A 3/2000 Weinberg
6,063,168 A 5/2000 Nichols et al.
6,086,657 A 7/2000 Freije
6,090,189 A 7/2000 Wikström et al.
6,117,216 A 9/2000 Loreth
6,118,645 A 9/2000 Partridge
6,126,722 A 10/2000 Mitchell et al.
6,126,727 A 10/2000 Lo
6,149,717 A 11/2000 Satyapal et al.
6,149,815 A 11/2000 Sauter
6,152,146 A 11/2000 Taylor et al.
6,163,098 A 12/2000 Taylor et al.
6,176,977 B1 * 1/2001 Taylor et al. ..... 204/176
6,182,461 B1 2/2001 Washburn et al.
6,182,671 B1 2/2001 Taylor et al.
6,187,271 B1 2/2001 Lee et al.
6,193,852 B1 2/2001 Caracciolo et al.
6,203,600 B1 3/2001 Loreth
6,212,883 B1 4/2001 Kang
6,228,149 B1 5/2001 Alenichev et al.
6,251,171 B1 6/2001 Marra et al.
6,252,012 B1 6/2001 Egitto et al.
6,270,733 B1 8/2001 Rodden
6,277,248 B1 8/2001 Ishioka et al.
6,282,106 B2 8/2001 Grass
D449,097 S 10/2001 Smith et al.
D449,679 S 10/2001 Smith et al.
6,296,692 B1 10/2001 Gutmann
6,302,944 B1 10/2001 Hoenig
6,309,514 B1 10/2001 Conrad et al.
6,312,507 B1 11/2001 Taylor et al.
6,315,821 B1 11/2001 Pillion et al.
6,328,791 B1 12/2001 Pillion et al.
6,348,103 B1 2/2002 Ahlborn et al.
6,350,417 B1 2/2002 Lau et al.
6,362,604 B1 3/2002 Cravey
6,372,097 B1 4/2002 Chen
6,373,723 B1 4/2002 Wallgren et al.
6,379,427 B1 4/2002 Siess
6,391,259 B1 5/2002 Malkin et al.
6,398,852 B1 6/2002 Loreth
6,447,587 B1 9/2002 Pillion et al.
6,451,266 B1 9/2002 Lau et al.
6,464,754 B1 10/2002 Ford
6,471,753 B1 10/2002 Ahn et al.
6,494,940 B1 12/2002 Hak
6,497,754 B2 12/2002 Joannou
6,504,308 B1 1/2003 Krichtafovitch et al.
6,506,238 B1 1/2003 Endo
6,508,982 B1 1/2003 Shoji
6,544,485 B1 4/2003 Taylor
6,576,046 B2 6/2003 Pruette et al.
6,588,434 B2 7/2003 Taylor et al.
6,603,268 B2 8/2003 Lee
6,613,277 B1 9/2003 Monagan
6,632,407 B1 10/2003 Lau et al.
6,635,105 B2 10/2003 Ahlborn et al.
6,635,106 B2 10/2003 Katou et al.
6,672,315 B2 1/2004 Taylor et al.
6,680,028 B1 1/2004 Harris
6,709,484 B2 * 3/2004 Lau et al. ..... 95/76
6,713,026 B2 3/2004 Taylor et al.
6,735,830 B1 5/2004 Merciel
6,749,667 B2 6/2004 Reeves et al.
6,753,652 B2 6/2004 Kim
6,761,796 B2 7/2004 Srivastava et al.
6,768,108 B2 7/2004 Hirano et al.
6,768,110 B2 7/2004 Alani
6,768,120 B2 7/2004 Leung et al.
6,768,121 B2 7/2004 Horsky
6,770,878 B2 8/2004 Uhlemann et al.
6,774,359 B1 8/2004 Hirabayashi et al.
6,777,686 B2 8/2004 Olson et al.
6,777,699 B1 8/2004 Miley et al.
6,777,882 B2 8/2004 Goldberg et al.
6,781,136 B1 8/2004 Kato
6,785,912 B1 9/2004 Julio
6,791,814 B2 9/2004 Adachi et al.
6,794,661 B2 9/2004 Tsukihara et al.
6,797,339 B2 9/2004 Akizuki et al.
6,797,964 B2 9/2004 Yamashita
6,799,068 B1 9/2004 Hartmann et al.
6,800,862 B2 10/2004 Matsumoto et al.
6,803,585 B2 10/2004 Glukhoy
6,805,916 B2 10/2004 Cadieu
6,806,035 B1 10/2004 Atireklapvarodom et al.
6,806,163 B2 10/2004 Wu et al.
6,806,468 B2 10/2004 Laiko et al.
6,808,606 B2 10/2004 Thomsen et al.
6,809,310 B2 10/2004 Chen
6,809,312 B1 10/2004 Park et al.
6,809,325 B2 10/2004 Dahl et al.
6,812,647 B2 11/2004 Cornelius
6,815,690 B2 11/2004 Veerasamy et al.
6,818,257 B2 11/2004 Amann et al.
6,818,909 B2 11/2004 Murrell et al.
6,819,053 B2 11/2004 Johnson
6,863,869 B2 3/2005 Lau
6,893,618 B2 5/2005 Kotlyar et al.
6,897,617 B2 5/2005 Lee
6,899,745 B2 5/2005 Gatchell et al.
6,908,501 B2 6/2005 Reeves et al.
6,911,186 B2 * 6/2005 Taylor et al. ..... 422/186.07

| | | | | |
|---|---|---|---|---|
| 6,958,134 | B2 | 10/2005 | Taylor et al. | |
| 6,974,560 | B2 | 12/2005 | Taylor et al. | |
| 6,984,987 | B2 * | 1/2006 | Taylor et al. | 324/509 |
| 7,077,890 | B2 * | 7/2006 | Botvinnik | 96/69 |
| 2001/0048906 | A1 | 12/2001 | Lau et al. | |
| 2002/0079212 | A1 | 6/2002 | Taylor et al. | |
| 2002/0098131 | A1 | 7/2002 | Taylor et al. | |
| 2002/0122751 | A1 | 9/2002 | Sinaiko et al. | |
| 2002/0122752 | A1 | 9/2002 | Taylor et al. | |
| 2002/0127156 | A1 | 9/2002 | Taylor | |
| 2002/0134665 | A1 | 9/2002 | Taylor et al. | |
| 2002/0144601 | A1 | 10/2002 | Palestro et al. | |
| 2002/0146356 | A1 | 10/2002 | Sinaiko et al. | |
| 2002/0150520 | A1 | 10/2002 | Taylor et al. | |
| 2002/0152890 | A1 | 10/2002 | Leiser | |
| 2002/0155041 | A1 | 10/2002 | McKinney, Jr. et al. | |
| 2002/0190658 | A1 | 12/2002 | Lee | |
| 2002/0195951 | A1 | 12/2002 | Lee | |
| 2003/0170150 | A1 | 9/2003 | Law et al. | |
| 2003/0206837 | A1 | 11/2003 | Taylor et al. | |
| 2003/0206840 | A1 * | 11/2003 | Taylor et al. | 422/186.04 |
| 2004/0033176 | A1 | 2/2004 | Lee et al. | |
| 2004/0096376 | A1 | 5/2004 | Taylor | |
| 2004/0136863 | A1 | 7/2004 | Yates et al. | |
| 2004/0166037 | A1 | 8/2004 | Youdell et al. | |
| 2004/0226447 | A1 | 11/2004 | Lau et al. | |
| 2004/0234431 | A1 | 11/2004 | Taylor et al. | |
| 2004/0251124 | A1 | 12/2004 | Lau | |
| 2004/0251909 | A1 * | 12/2004 | Taylor et al. | 324/509 |
| 2005/0000793 | A1 | 1/2005 | Taylor et al. | |
| 2005/0051028 | A1 * | 3/2005 | Botvinnik | 96/88 |
| 2005/0051420 | A1 * | 3/2005 | Botvinnik et al. | 204/164 |

FOREIGN PATENT DOCUMENTS

| | | | |
|---|---|---|---|
| CN | 2138764 | Y | 6/1993 |
| CN | 2153231 | Y | 12/1993 |
| DE | 2206057 | | 8/1973 |
| DE | 197 41 621 C 1 | | 6/1999 |
| EP | 0 433 152 | A1 | 12/1990 |
| EP | 0 332 624 | B1 | 1/1992 |
| FR | 2690509 | | 10/1993 |
| GB | 643363 | | 9/1950 |
| JP | S51-90077 | | 8/1976 |
| JP | S62-20653 | | 2/1987 |
| JP | S63-164948 | | 10/1988 |
| JP | 10137007 | | 5/1998 |
| JP | 11104223 | | 4/1999 |
| JP | 2000236914 | | 9/2000 |
| WO | WO 92/05875 | A1 | 4/1992 |
| WO | WO 96/04703 | A1 | 2/1996 |
| WO | WO 99/07474 | A1 | 2/1999 |
| WO | WO 00/10713 | A1 | 3/2000 |
| WO | WO 01/47803 | A1 | 7/2001 |
| WO | WO 01/48781 | A1 | 7/2001 |
| WO | WO 01/64349 | A1 | 9/2001 |
| WO | WO 01/85348 | A2 | 11/2001 |
| WO | WO 02/20162 | A2 | 3/2002 |
| WO | WO 02/20163 | A2 | 3/2002 |
| WO | WO 02/30574 | A1 | 4/2002 |
| WO | WO 02/32578 | A1 | 4/2002 |
| WO | WO 02/42003 | A1 | 5/2002 |
| WO | WO 02/066167 | A1 | 8/2002 |
| WO | WO 03/009944 | A1 | 2/2003 |
| WO | WO 03/013620 | A1 | 2/2003 |
| WO | WO 03/013734 AA | | 2/2003 |

* cited by examiner

AIR CONDITIONER DEVICE WITH A REMOVABLE DRIVER ELECTRODE

PRIORITY CLAIM

This application claims priority to, and the benefit of, U.S. Provisional Application Ser. No. 60/590,960, filed Jul. 23, 2004, the entire contents of which are hereby incorporated by reference.

BACKGROUND OF THE INVENTION

The use of an electric motor to rotate a fan blade to create an airflow has long been known in the art. Although such fans can produce substantial airflow (e.g., 1,000 ft3/minute or more), substantial electrical power is required to operate the motor, and essentially no conditioning of the flowing air occurs.

CROSS-REFERENCE TO RELATED APPLICATIONS

This application relates to the following co-owned and co-pending applications:

U.S. patent application Ser. No. Filed
90/007,276 Oct. 29, 2004
11/041,926 Jan. 21, 2005
11/091,243 Mar. 28, 2005
11/062,057 Feb. 18, 2005
11/071,779 Mar. 3, 2005
10/994,869 Nov. 22, 2004
11/007,556 Dec. 8, 2004
10/074,209 Feb. 12, 2002
10/685,182 Oct. 14, 2003
10/944,016 Sep. 17, 2004
10/795,934 Mar. 8, 2004
10/435,289 May 9, 2003
11/064,797 Feb. 24, 2005
11/003/671 Dec. 3, 2004
11/003,035 Dec. 3, 2004
11/007,395 Dec. 8, 2004
10/876,495 Jun. 25, 2004
10/809,923 Mar. 25, 2004
11/004,397 Dec. 3, 2004
10/895,799 Jul. 21, 2004
10/642,927 Aug. 18, 2003
10/823,346 Apr. 12, 2004
10/662,591 Sep. 15, 2003
11/061,967 Feb. 18, 2005
11/150,046 Jun. 10, 2005
11/188,448 Jul. 25, 2005
11/293,538 Dec. 2, 2005
11/457,396 Jul. 13, 2006
11/464,139 Aug. 11, 2006
11/694,281 Mar. 30, 2007

It is known to provide such fans with a HEPA-compliant filter element to remove particulate matter larger than perhaps 0.3 gm. Unfortunately, the resistance to airflow presented by the filter element may require doubling the electric motor size to maintain a desired level of airflow. Further, HEPA-compliant filter elements are expensive, and can represent a substantial portion of the sale price of a HEPA-compliant filter-fan unit. While such filter-fan units can condition the air by removing large particles, particulate matter small enough to pass through the filter element is not removed, including bacteria, for example.

It is also known in the art to produce an airflow using electro-kinetic technique whereby electrical power is converted into a flow of air without utilizing mechanically moving components. One such system is described in U.S. Pat. No. 4,789,801 to Lee (1988), depicted herein in simplified form as FIGS. 1A and 1B, which is hereby incorporated by reference. System 10 includes an array of first ("emitter") electrodes or conductive surfaces 20 that are spaced-apart from an array of second ("collector") electrodes or conductive surfaces 30. The positive terminal of a generator such as, for example, pulse generator 40 which outputs a train of high voltage pulses (e.g., 0 to perhaps +5 KV) is coupled to the first array 20, and the negative pulse generator terminal is coupled to the second array 30 in this example.

The high voltage pulses ionize the air between the arrays 20, 30 and create an airflow 50 from the first array 20 toward the second array 30, without requiring any moving parts. Particulate matter 60 entrained within the airflow 50 also moves towards the second electrodes 30. Much of the particulate matter is electrostatically attracted to the surfaces of the second electrodes 30, where it remains, thus conditioning the flow of air that is exiting the system 10. Further, the high voltage field present between the electrode sets releases ozone 03, into the ambient environment, which eliminates odors that are entrained in the airflow.

In the particular embodiment of FIG. 1A, the first electrodes 20 are circular in cross-section, having a diameter of about 0.003" (0.08 mm), whereas the second electrodes 30 are substantially larger in area and define a "teardrop" shape in cross-section. The ratio of cross-sectional radii of curvature between the bulbous front nose of the second electrode 30 and the first electrodes 20 exceeds 10:1. As shown in FIG. 1A, the bulbous front surfaces of the second electrodes 30 face the first electrodes 20, and the somewhat "sharp" trailing edges face the exit direction of the airflow. In another particular embodiment shown herein as FIG. 1B, second electrodes 30 are elongated in cross-section. The elongated trailing edges on the second electrodes 30 provide increased area upon which particulate matter 60 entrained in the airflow can attach.

DETAILED DESCRIPTION OF THE PRESENT INVENTION

An air transporting and/or conditioning device comprising a housing having an inlet and outlet grill, an emitter electrode configured within the housing, a collector electrode configured within the housing and positioned downstream from the emitter electrode, and a driver electrode removable from the housing independent of the collector electrode and the grills. The driver electrode is preferably removable from the housing through a side portion of the housing. Preferably, the driver electrode is insulated with a dielectric material and/or a catalyst. Preferably, a removable trailing electrode is configured within the housing and downstream of the collector electrode. Preferably, a first voltage source electrically is coupled to the emitter electrode and the collector electrode, and a second voltage source electrically is coupled to the trailing electrode. The second voltage source is independently and selectively controllable of the first voltage source.

Figure 1A:
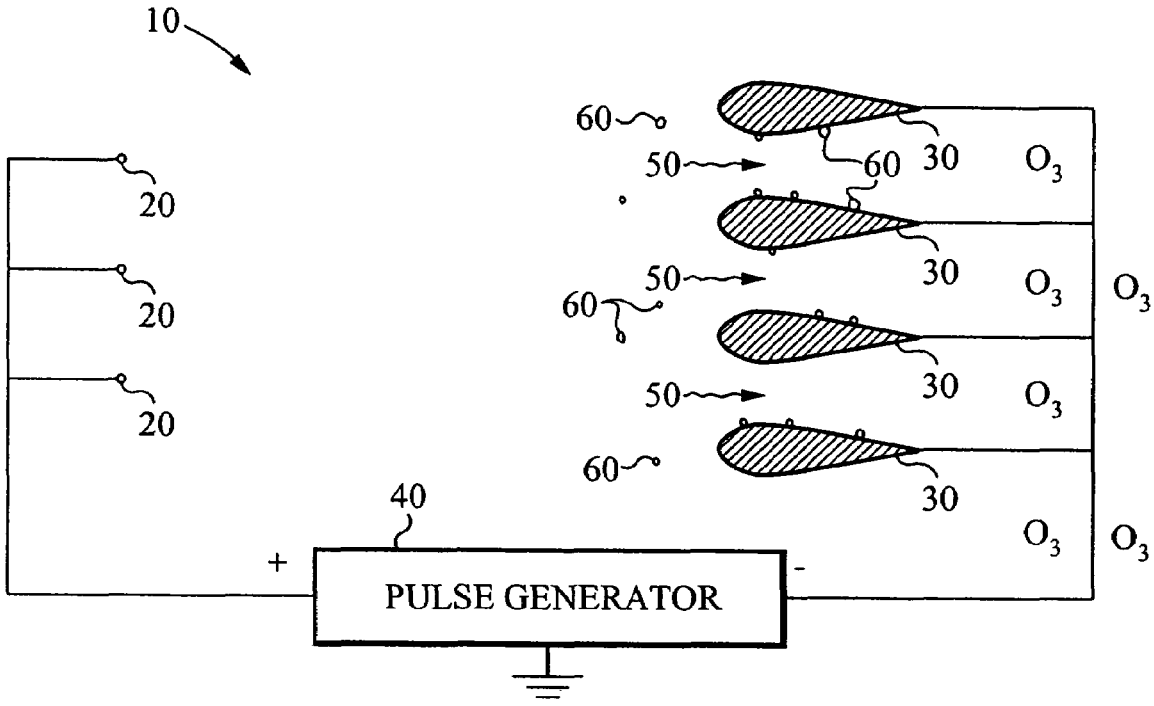
Fig. 1A (PRIOR ART)
FIG. 1A illustrates a plan, cross-sectional view, of a prior art electro-kinetic air transporter-conditioner system.
Figure 1B:
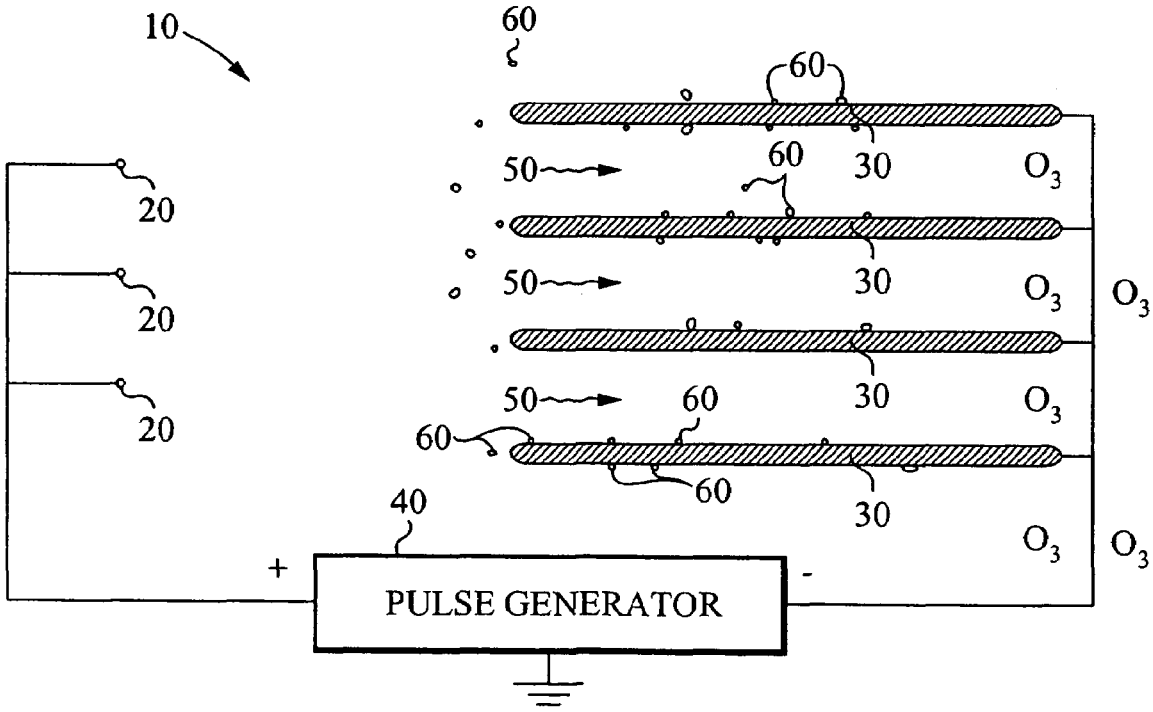
Fig. 1B (PRIOR ART)
FIG. 1B illustrates a plan, cross-sectional view of a prior art electro-kinetic air transporter-conditioner system.
Figure 2:
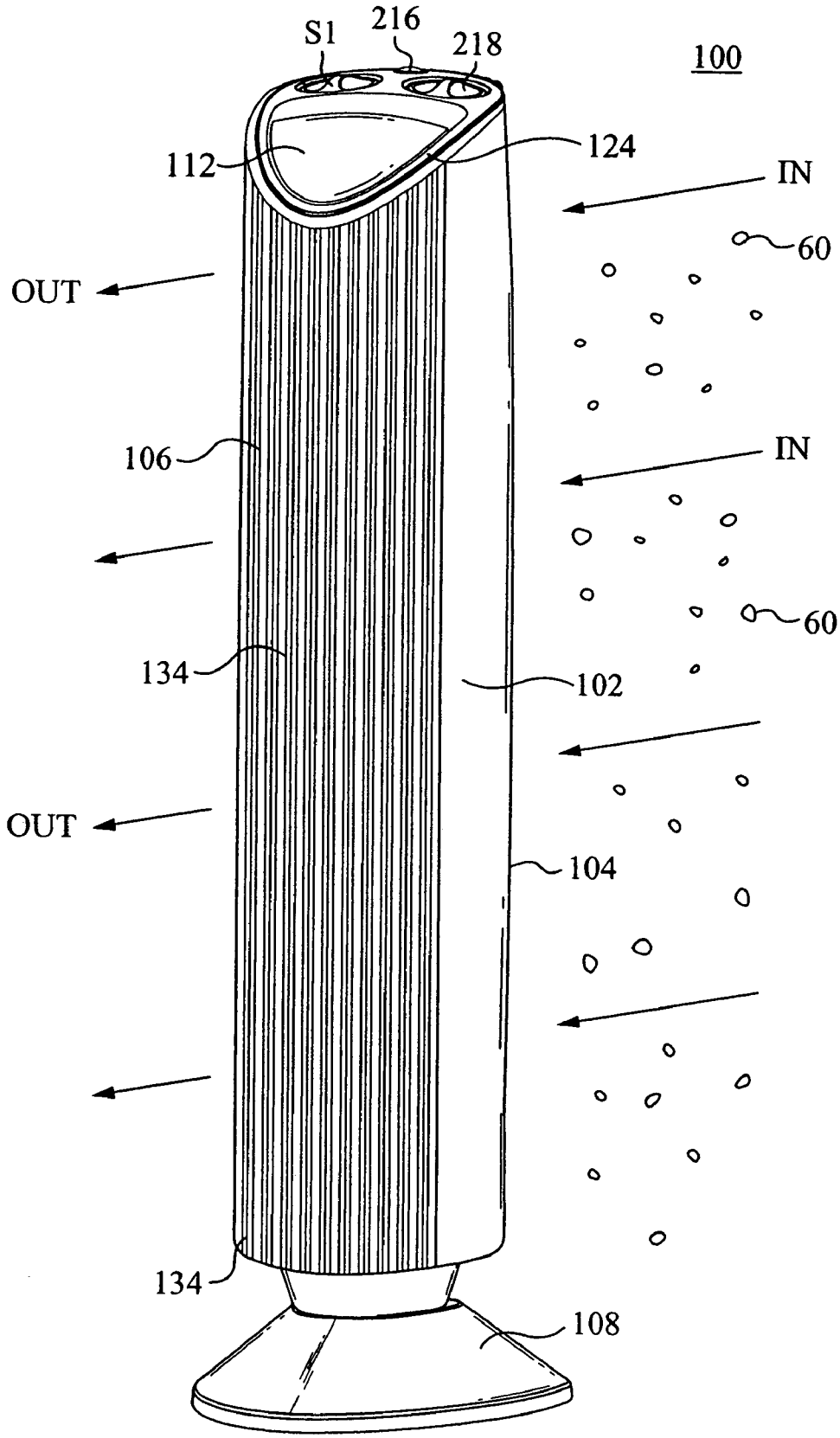
FIG. 2 illustrates a perspective view of the device in accordance with one embodiment of the present invention.

FIG. 2 depicts one embodiment of the air transporter-conditioner system 100 whose housing 102 preferably includes a removable rear-located intake grill 104, a removable front-located exhaust grill 106, and a base pedestal 108. Alternatively, a single grill provides both an air intake and an air exhaust with an air inlet channel and an air exhaust channel communicating with the grill and the air movement system within. The housing 102 is preferably freestanding and/or upstandingly vertical and/or elongated. Internal to the transporter housing 102 is an ion generating unit 220 (FIG. 3), also referred to as an electrode assembly, which is preferably powered by an AC:DC power supply that is energizable or excitable using a switch S1. S1 is conveniently located at the top 124 of the housing 102. Located preferably on top 124 of the housing 102 is a boost button 216 which can boost the ion output of the system, as will be discussed below. The ion generating unit 220 (FIG. 3) is self-contained in that, other than ambient air, nothing is required from beyond the housing 102, save external operating potential, for operation of the present invention. In one embodiment, a fan is utilized to supplement and/or replace the movement of air caused by the operation of the electrode assembly 220 (FIG. 3), as described below. In one embodiment, the system 100 includes a germicidal lamp (FIG. 3) which reduces the amount of microorganisms exposed to the lamp when passed through the system 100. The germicidal lamp 290 (FIG. 5A) is preferably a UV-C lamp that emits radiation having wavelength of about 254 nm, which is effective in diminishing or destroying bacteria, germs, and viruses to which it is exposed. More detail regarding the germicidal lamp is described in the U.S. patent application Ser. No. 10/074,347 and now U.S. Pat. No. 6,911,186, which is incorporated by reference above. Tn another embodiment, the system 100 does not utilize the germicidal lamp 290.

The general shape of the housing 102 in the embodiment shown in FIG. 2 is that of an oval cross-section. Alternatively, the housing 102 includes a differently shaped cross-section such as, but not limited to, a rectangular shape, a figure-eight shape, an egg shape, a tear-drop shape, or circular shape. As will become apparent later, the housing 102 is shaped to contain the air movement system. In one embodiment, the air movement system is the ion generator 220 (FIG. 3), as discussed below. Alternatively, or additionally, the air movement system is a fan or other appropriate mechanism.

Both the inlet and the outlet grills 104, 106 are covered by fins, also referred to as louvers 134. In accordance with one embodiment, each fin 134 is a thin ridge spaced-apart from the next fin 134, so that each fin 134 creates minimal resistance as air flows through the housing 102. As shown in FIG. 2, the fins 134 are vertical and are directed along the elongated vertical upstanding housing 102 of the system 100, in one embodiment. Alternatively, the fins 134 are perpendicular to the elongated housing 102 and are configured horizontally. In one embodiment, the inlet and outlet fins 134 are aligned to give the unit a "see through" appearance. Thus, a user can "see through" the system 100 from the inlet to the outlet or vice versa. The user will see no moving parts within the housing, but just a quiet unit that cleans the air passing therethrough. Other orientations of fins 134 and electrodes are contemplated in other embodiments, such as a configuration in which the user is unable to see through the system 100 which contains the germicidal lamp 290 (FIG. 5A) therein, but without seeing the direct radiation from the lamp 290. More details regarding this configuration are described in the U.S. patent application Ser. No. 10/074,347 which is incorporated by reference above. There is preferably no distinction between grills 104 and 106, except their location relative to the collector electrodes 242 (FIG. 6). Alternatively, the grills 104 and 106 are configured differently and are distinct from one another. The grills 104, 106 serve to ensure that an adequate flow of ambient air is drawn into or made available to the system 100 and that an adequate flow of ionized air that includes appropriate amounts of ozone flows out from the system 100 via the exhaust grill 106.

When the system 100 is energized by activating switch S1, high voltage or high potential output by the ion generator 220 produces at least ions within the system 100. The "IN" notation in FIG. 2 denotes the intake of ambient air with particulate matter 60 through the inlet grill 104. The "OUT" notation in FIG. 2 denotes the outflow of cleaned air through the exhaust grill 106 substantially devoid of the particulate matter 60. It is desired to provide the inner surface of the housing 102 with an electrostatic shield to reduce detectable electromagnetic radiation. For example, a metal shield is disposed within the housing 102, or portions of the interior of the housing 102 are alternatively coated with a metallic paint.

Figure 3:
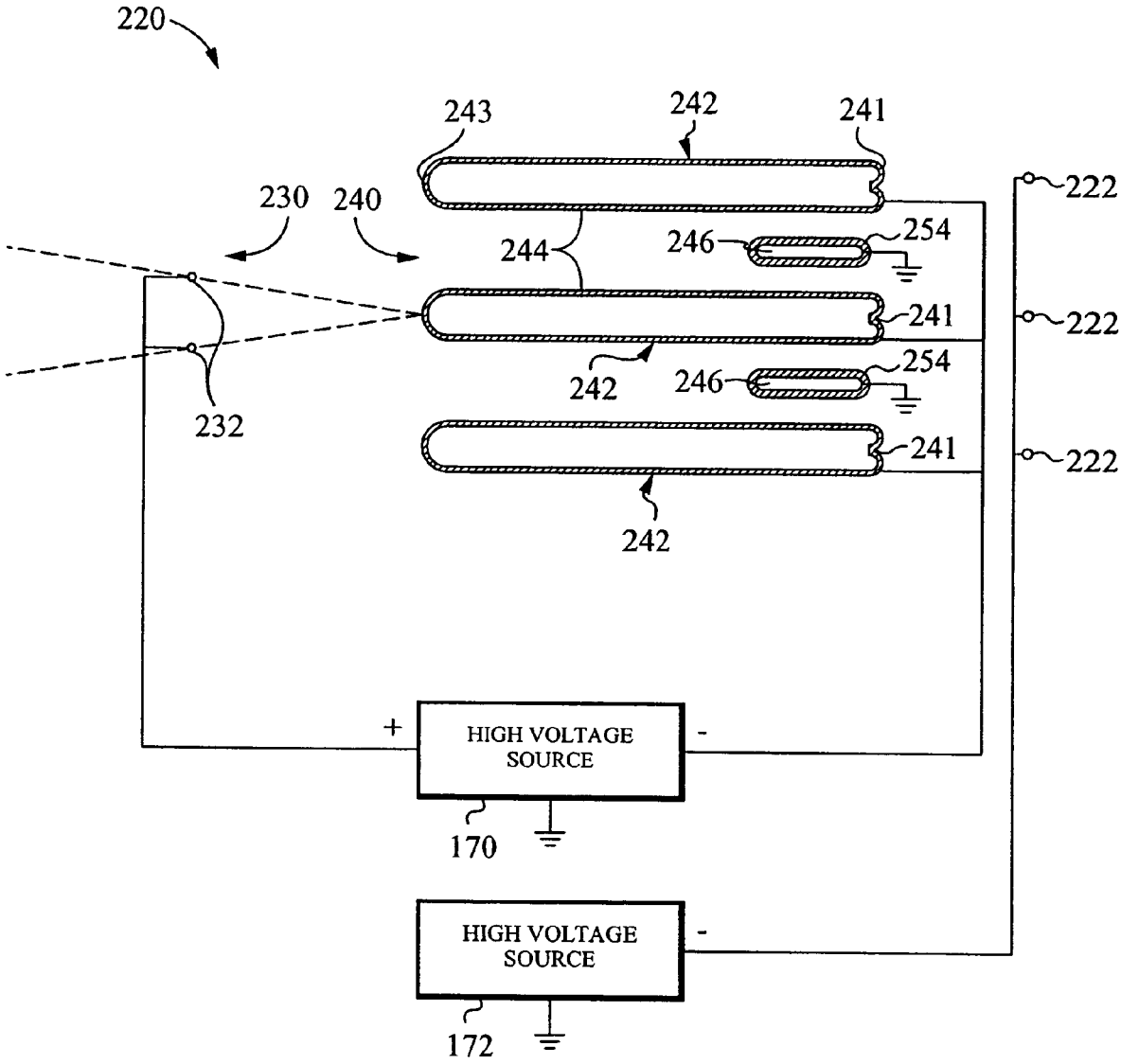
FIG. 3 illustrates a plan view of the electrode assembly in accordance with one embodiment of the present invention.

FIG. 3 illustrates a plan view of the electrode assembly in accordance with one embodiment of the present invention. The electrode assembly 220 is shown to include the first electrode set 230, having the emitter electrodes 232, and the second electrode set 240, having the collector electrodes 242, preferably downstream from the first electrode set 230. In the embodiment shown in FIG. 3, the electrode assembly 220 also includes a set of driver electrodes 246 located interstitially between the collector electrodes 242. It is preferred that the electrode assembly 220 additionally includes a set of trailing electrodes 222 downstream from the collector electrodes 242. It is preferred that the number N1 of emitter electrodes 232 in the first set 230 differ by one relative to the number N2 of collector electrodes 242 in the second set 240. Preferably, the system includes a greater number of collector electrodes 242 than emitter electrodes 232. However, if desired, additional emitter electrodes 232 are alternatively positioned at the outer ends of set 230 such that N1>N2, e.g., five emitter electrodes 232 compared to four collector electrodes 242. Alternatively, instead of multiple electrodes, single electrodes or single conductive surfaces are substituted. It is apparent that other numbers and arrangements of emitter electrodes 232, collector electrodes 244, trailing electrodes 222 and driver electrodes 246 are alternatively configured in the electrode assembly 220 in other embodiments.

The material(s) of the electrodes 232 and 242 should conduct electricity and be resistant to the corrosive effects from the application of high voltage, but yet be strong and durable enough to be cleaned periodically In one embodiment, the emitter electrodes 232 are preferably fabricated from tungsten. Tungsten is sufficiently robust in order to withstand cleaning, has a high melting point to retard breakdown due to ionization, and has a rough exterior surface that promotes efficient ionization. The collector electrodes 242 preferably have a highly polished exterior surface to minimize unwanted point-to-point radiation. As such, the collector electrodes 242 are fabricated from stainless steel and/or brass, among other appropriate materials. The polished surface of electrodes 232 also promotes ease of electrode cleaning. The materials and construction of the electrodes 232 and 242, allow the electrodes 232, 242 to be light weight, easy to fabricate, and lend themselves to mass production. Further, electrodes 232 and 242 described herein promote more efficient generation of ionized air, and appropriate amounts of ozone.

As shown in FIG. 3, one embodiment of the present invention includes a first high voltage source (HVS) 170 and a second high power voltage source 172. The positive output terminal of the first HVS 170 is coupled to the emitter electrodes 232 in the first electrode set 230, and the negative output terminal of first HVS 170 is coupled to collector electrodes 242. This coupling polarity has been found to work well and minimizes unwanted audible electrode vibration or hum. It is noted that in some embodiments, one port, such as the negative port, of the high voltage power supply can in fact be the ambient air. Thus, the electrodes 242 in the second set 240 need not be connected to the first HVS 170 using a wire. Nonetheless, there will be an "effective connection" between the collector electrodes 242 and one output port of the first HVS 170, in this instance, via ambient air. Alternatively the negative output terminal of first HVS 170 is connected to the first electrode set 230 and the positive output terminal is connected to the second electrode set 240.

When voltage or pulses from the first HVS 170 are generated across the first and second electrode sets 230 and 240, a plasma-like field is created surrounding the electrodes 232 in first set 230. This electric field ionizes the ambient air between the first and the second electrode sets 230, 240 and establishes an "OUT" airflow that moves towards the second electrodes 240, which is herein referred to as the ionization region. It is understood that the IN flow preferably enters via grill(s) 104 and that the OUT flow exits via grill(s) 106 as shown in FIG. 2.

Ozone and ions are generated simultaneously by the first electrodes 232 as a function of the voltage potential from the HVS 170. Ozone generation is increased or decreased by respectively increasing or decreasing the voltage potential at the first electrode set 230. Coupling an opposite polarity voltage potential to the second electrodes 242 accelerates the motion of ions from the first set 230 to the second set 240, thereby producing the airflow in the ionization region. Molecules as well as particulates in the air thus become ionized with the charge emitted by the emitter electrodes 232 as they pass by the electrodes 232. As the ions and ionized particulates move toward the second set 240, the ions and ionized particles push or move air molecules toward the second set 240. The relative velocity of this motion is increased, by way of example, by increasing the voltage potential at the second set 240 relative to the potential at the first set 230. Therefore, the collector electrodes 242 collect the ionized particulates in the air, thereby allowing the device 100 to output cleaner, fresher air.

As shown in the embodiment in FIG. 3, at least one output trailing electrode 222 is electrically coupled to the second HVS 172. The trailing electrode 222 generates a substantial amount of negative ions, because the electrode 222 is coupled to relatively negative high potential. In one embodiment, the trailing electrode(s) 222 is a wire positioned downstream from the second electrodes 242. In one embodiment, the electrode 222 has a pointed shape in the side profile, e.g., a triangle. Alternatively, at least a portion of the trailing edge in the second electrode 242 has a pointed electrode region which emits the supplemental negative ions, as described in U.S. patent application Ser. No. 10/074,347 which is incorporated by reference above.

The negative ions produced by the trailing electrode 222 neutralize excess positive ions otherwise present in the output airflow, such that the OUT flow has a net negative charge. The trailing electrodes 222 are preferably made of stainless steel, copper, or other conductor material. The inclusion of one electrode 222 has been found sufficient to provide a sufficient number of output negative ions. However, multiple trailing wire electrodes 222 are utilized in another embodiment.

When the trailing electrodes 222 are electrically connected to the negative terminal of the second HVS 172, the positively charged particles within the airflow will be attracted to and collect on the trailing electrodes 222. In a typical electrode assembly with no trailing electrode 222, most of the particles will collect on the surface area of the collector electrodes 242. However, some particles will pass through the system 100 without being collected by the collector electrodes 242. The trailing electrodes 222 can also serve as a second surface area to collect the positively charged particles. In addition, the energized trailing electrodes 222 can energize any remaining un-ionized particles leaving the air conditioner system 100. While the energized particles are not collected by the collector electrode 242, they maybe collected by other surfaces in the immediate environment in which collection will reduce the particles in the air in that environment.

The use of the driver electrodes 246 increase the particle collection efficiency of the electrode assembly 220 and reduces the percentage of particles that are not collected by the collector electrode 242. This is due to the driver electrode 246 pushing particles in air flow toward the inside surface 244 of the adjacent collector electrode(s) 242, which is referred to herein as the collecting region. The driver electrode 246 is preferably insulated which further increases particle collection efficiency as discussed below.

It is preferred that the collecting region between the driver electrode 246 and the collector electrode 242 does not interfere with the ionization region between the emitter electrode 232 and the collector electrode 242. If this were to occur, the electric field in the collecting region might reduce the intensity of the electric field in the ionization region, thereby reducing the production of ions and slowing down the airflow rate. Accordingly, the leading end (i.e., upstream end) of the driver electrode 246 is preferably set back (i.e., downstream) from the leading end of the collector electrode 242 as shown in FIG. 3. The downstream end of the driver electrode 246 is even with the downstream end of the collector electrode 242 as shown in FIG. 3. Alternatively, the downstream end the driver electrode 246 is positioned slightly upstream or downstream from the downstream end of the collector electrode 242.

The emitter electrode 232 and the driver electrode 246 may or may not be at the same voltage potential, depending on which embodiment of the present invention is practiced. When the emitter electrode 232 and the driver electrode 246 are at the same voltage potential, there will be no arcing which occurs between the emitter electrode 232 and the driver electrode 246.

As stated above, the system of the present invention will also produces ozone (03). In accordance with one embodiment of the present invention, ozone production is reduced by preferably coating the internal surfaces of the housing with an ozone reducing catalyst. In one embodiment, the driver electrodes 246 are coated with an ozone reducing catalyst. Exemplary ozone reducing catalysts include manganese dioxide and activated carbon. Commercially available ozone reducing catalysts such as PremAir™ manufactured by Englehard Corporation of Iselin, N.J., is alternatively used. Some ozone reducing catalysts are electrically conductive, while others are not electrically conductive (e.g., manganese dioxide). Preferably the ozone reducing catalysts should have a dielectric strength of at least 1000 V/mil (one-hundredth of an inch).

Figure 4:
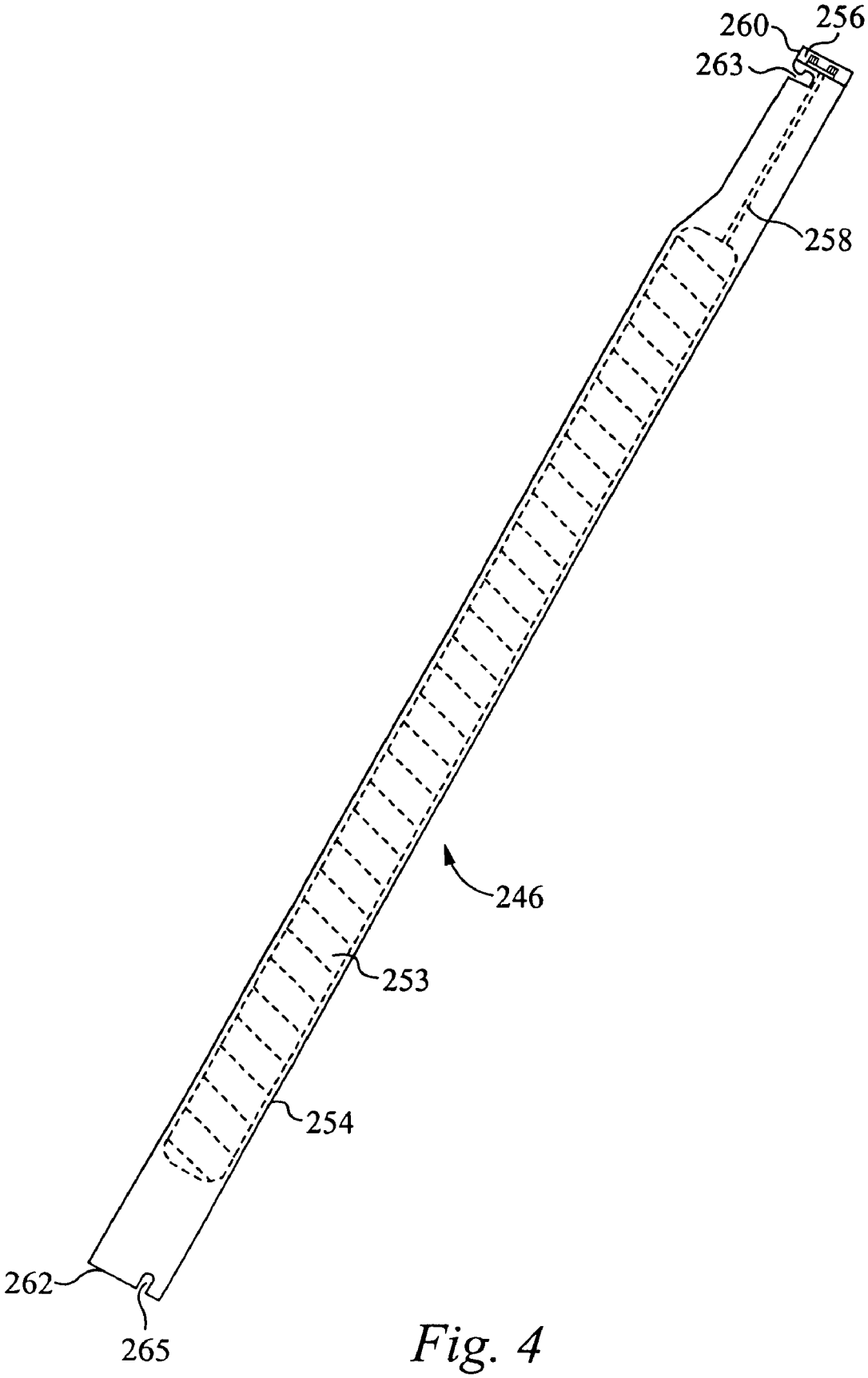
FIG. 4 illustrates a side view of the driver electrode in accordance with one embodiment of the present invention.

FIG. 4 illustrates a side view of an insulated driver electrode 246 in accordance with one embodiment of the present invention. The driver electrode 246 is preferably plate shaped and has a top end 260 and a bottom end 262 in one embodiment. As shown in FIG. 4, near the top end 260 is a receiving hook 263 which allows the driver electrode 246 to be attached to the housing 102. In addition, near the bottom end 262 is a detent 265 which secures the driver electrode 246 within the housing and prevents the driver electrode 246 from pivoting. In another embodiment, the driver electrode 246 comprises a series of conductive wires arranged in a line parallel to the collector electrodes 242 as discussed in U.S. Pat. No. 6,176,977, which is incorporated by reference above.

As shown in FIG. 4, the insulated driver electrode 246 includes an electrically conductive electrode 253 that is coated with an insulating dielectric material 254. In accordance with one embodiment of the present invention, the driver electrode is made of a non-conducting substrate such as a printed circuit board (PCB) having a conductive member which is preferably covered by one or more additional layers of insulated material 254. Exemplary insulated PCBs are generally commercially available and maybe found from a variety of sources, including for example Electronic Service and Design Corp, of Harrisburg, Pa. In embodiments where the driver electrode 246 is not insulated, the driver electrode 246 simply includes the electrically conductive electrode 253. In one embodiment, the insulated driver electrode 246 includes a contact terminal 256 along the top end 260. In another embodiment, the terminal 256 is located along the bottom end 262 or elsewhere in the driver electrode 246. The terminal 256 electrically connects the driver electrode 246 to a voltage potential (e.g. HVS), and alternatively to ground. The electrically conductive electrode 253 is preferably connected to the terminal 256 by one or more conductive trace lines 258 as shown in FIG. 4. Alternatively, the electrically conductive electrode 253 is directly in contact with the terminal 256.

In accordance with one embodiment of the present invention, the insulating dielectric material 254 is a heat shrink material. During manufacture, the heat shrink material is placed over the electrically conductive electrode 253 and then heated, which causes the material to shrink to the shape of the conductive electrode 253. An exemplary heat shrinkable material is type FP-301 flexible polyolefin material available from 3M® of St. Paul, Minn. It should be noted that any other appropriate heat shrinkable material is also contemplated. In another embodiment, the dielectric material 254 is an insulating varnish, lacquer or resin. For example only, a varnish, after being applied to the surface of the underlying electrode 253, dries and forms an insulating coat or film which is a few mil (thousands of an inch) in thickness. The dielectric strength of the varnish or lacquer can be, for example, above 1000 V/mil. Such insulating varnishes, lacquer and resins are commercially available from various sources, such as from John C. Dolph Company of Monmouth Junction, N.J., and Ranbar Electrical Materials Inc. of Manor, Pa. Other possible dielectric materials 254 that can be used to insulate the driver electrode 253 include, but are not limited to, ceramic, porcelain enamel or fiberglass.

The extent that the voltage difference (and thus, the electric field) between the collector electrodes 242 and un-insulated driver electrodes 246 can be increased beyond a certain voltage potential difference is limited due to arcing which may occur. However, with the insulated drivers 246, the voltage potential difference that can be applied between the collector electrodes 242 and the driver electrodes 246 without arcing is significantly increased. The increased potential difference results in an increased electric field, which also significantly increases particle collecting efficiency.

In one embodiment, the driver electrodes 246 are electrically connected to ground as shown in FIG. 3. Although the grounded drivers 246 do not receive a charge from either the first or second HVS 170, 172, the drivers 246 may still deflect positively charged particles toward the collector electrodes 242. In another embodiment, the driver electrodes 246 are positively charged. In particular, the drivers 246 are electrically coupled to the positive terminal of either the first or second HVS 170, 172. The emitter electrodes 232 apply a positive charge to particulates passing by the electrodes 232. In order to clean the air of particles, it is desirable that the particles stick to the collector electrode 242 (which can later be cleaned). The electric fields which are produced between the driver electrodes 246 and the collector electrodes 242 will thus push the positively charged particles toward the collector electrodes 204. Generally, the greater this electric field between the driver electrodes 246 and the collector electrodes 242, the greater the migration velocity and the particle collection efficiency of the electrode assembly 220. In yet another embodiment, the driver electrodes 246 are electrically coupled to the negative terminal of either the first or second HVS 170, 172, whereby the driver electrodes 246 are preferably charged at a voltage that is less than the negatively charged collector electrodes 242.

Figure 5A:
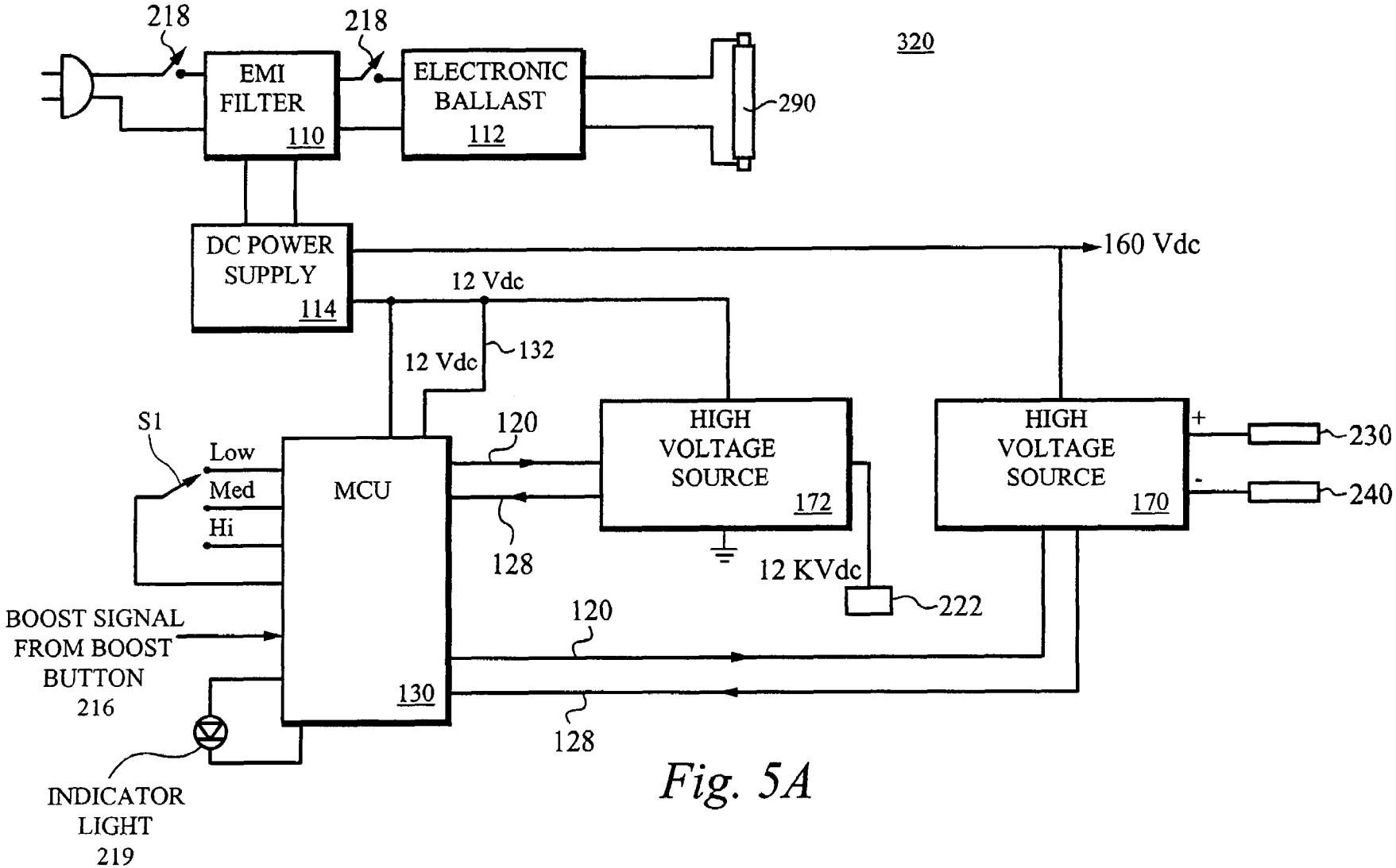
FIG. 5A illustrates an electrical block diagram of the high voltage power source of one embodiment of the present invention.
Figure 6:
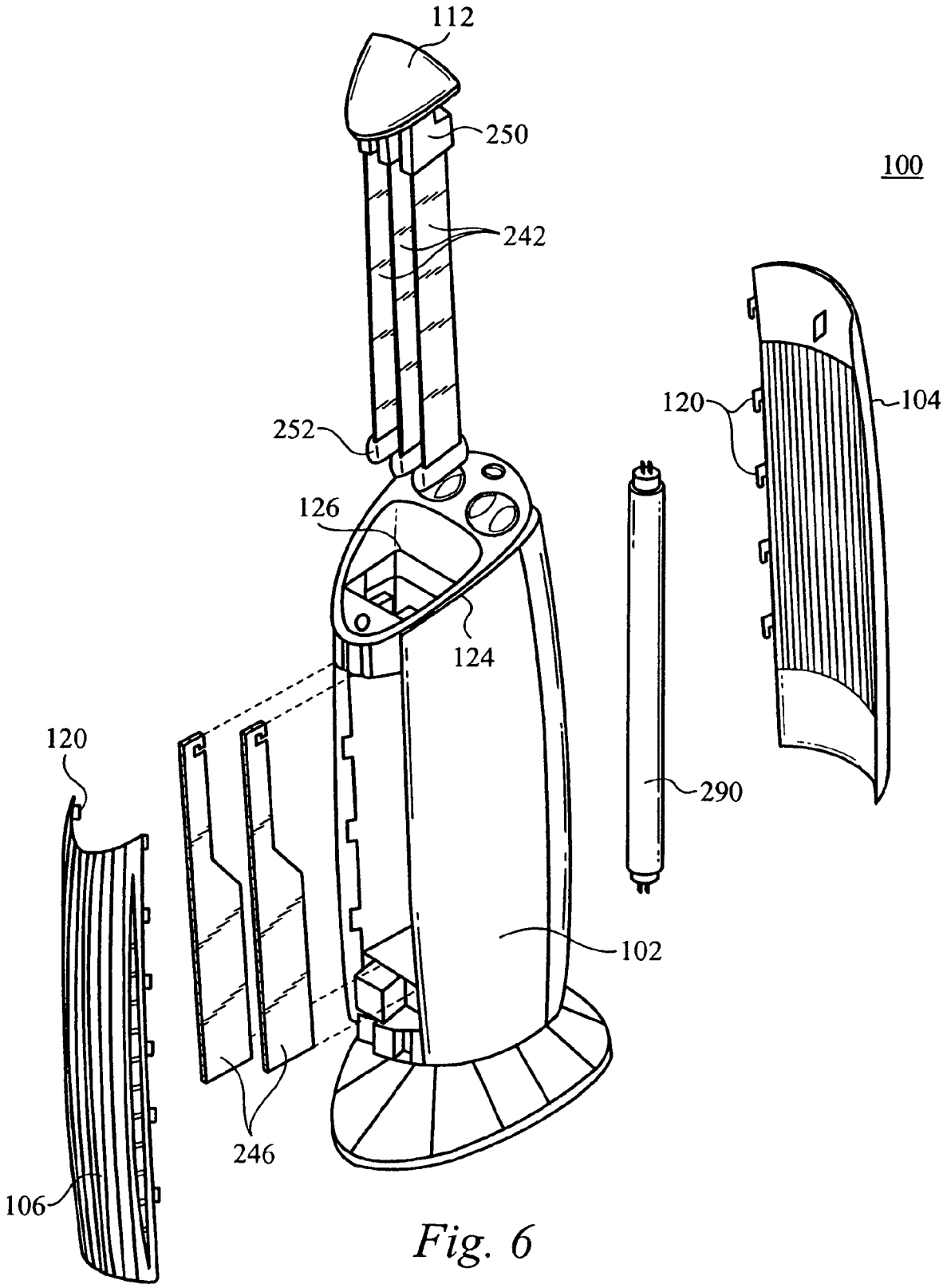
FIG. 6 illustrates an exploded view of the device shown in FIG. 2 in accordance with one embodiment of the present invention.

FIG. 5A illustrates an electrical circuit diagram for the system 100, according to one embodiment of the present invention. The system 100 has an electrical power cord that plugs into a common electrical wall socket that provides a nominal 110 VAC. An electromagnetic interference (EMI) filter 110 is placed across the incoming nominal 110 VAC line to reduce and/or eliminate high frequencies generated by the various circuits within the system 100, such as the electronic ballast 112. In one embodiment, the electronic ballast 112 is electrically connected to a germicidal lamp 290 (e.g. an ultraviolet lamp) to regulate, or control, the flow of current through the lamp 290. A switch 218 is used to turn the lamp 290 on or off. The EMI Filter 110 is well known in the art and does not require a further description. In another embodiment, the system 100 does not include the germicidal lamp 290, whereby the circuit diagram shown in FIG. 5A would not include the electronic ballast 112, the germicidal lamp 290, nor the switch 218 used to operate the germicidal lamp 290.

The EMI filter 110 is coupled to a DC power supply 114. The DC power supply 114 is coupled to the first HVS 170 as well as the second high voltage power source 172. The high voltage power source can also be referred to as a pulse generator. The DC power supply 114 is also coupled to the micro-controller unit (MCU) 130. The MCU 130 can be, for example, a Motorola 68HC908 series micro-controller, available from Motorola. Alternatively, any other type of MCU is contemplated. The MCU 130 can receive a signal from the switch S1 as well as a boost signal from the boost button 216. The MCU 130 also includes an indicator light 219 which specifies when the electrode assembly is ready to be cleaned.

The DC Power Supply 114 is designed to receive the incoming nominal 110 VAC and to output a first DC voltage (e.g., 160 VDC) to the first HVS 170. The DC Power Supply 114 voltage (e.g., 160 VDC) is also stepped down to a second DC voltage (e.g., 12 VDC) for powering the micro-controller unit (MCU) 130, the HVS 172, and other internal logic of the system 100. The voltage is stepped down through a resistor network, transformer or other component.

As shown in FIG. 5A, the first HVS 170 is coupled to the first electrode set 230 and the second electrode set 240 to provide a potential difference between the electrode sets. In one embodiment, the first HVS 170 is electrically coupled to the driver electrode 246, as described above. In addition, the first HVS 170 is coupled to the MCU 130, whereby the MCU receives arc sensing signals 128 from the first HVS 170 and provides low voltage pulses 120 to the first HVS 170. Also shown in FIG. 5A is the second HVS 172 which provides a voltage to the trailing electrodes 222. In addition, the second HVS 172 is coupled to the MCU 130, whereby the MCU receives arc sensing signals 128 from the second HVS 172 and provides low voltage pulses 120 to the second HVS 172.

In accordance with one embodiment of the present invention, the MCU 130 monitors the stepped down voltage (e.g., about 12 VDC), which is referred to as the AC voltage sense signal 132 in FIG. 5A, to determine if the AC line voltage is above or below the nominal 110 VAC, and to sense changes in the AC line voltage. For example, if a nominal 110 VAC increases by 10% to 121 VAC, then the stepped down DC voltage will also increase by 10%. The MCU 130 can sense this increase and then reduce the pulse width, duty cycle and/or frequency of the low voltage pulses to maintain the output power (provided to the HVS 170) to be the same as when the line voltage is at 110 VAC. Conversely, when the line voltage drops, the MCU 130 can sense this decrease and appropriately increase the pulse width, duty cycle and/or frequency of the low voltage pulses to maintain a constant output power. Such voltage adjustment features of the present invention also enable the same system 100 to be used in different countries that have different nominal voltages than in the United States (e.g., in Japan the nominal AC voltage is 100 VAC).

Figure 5B:
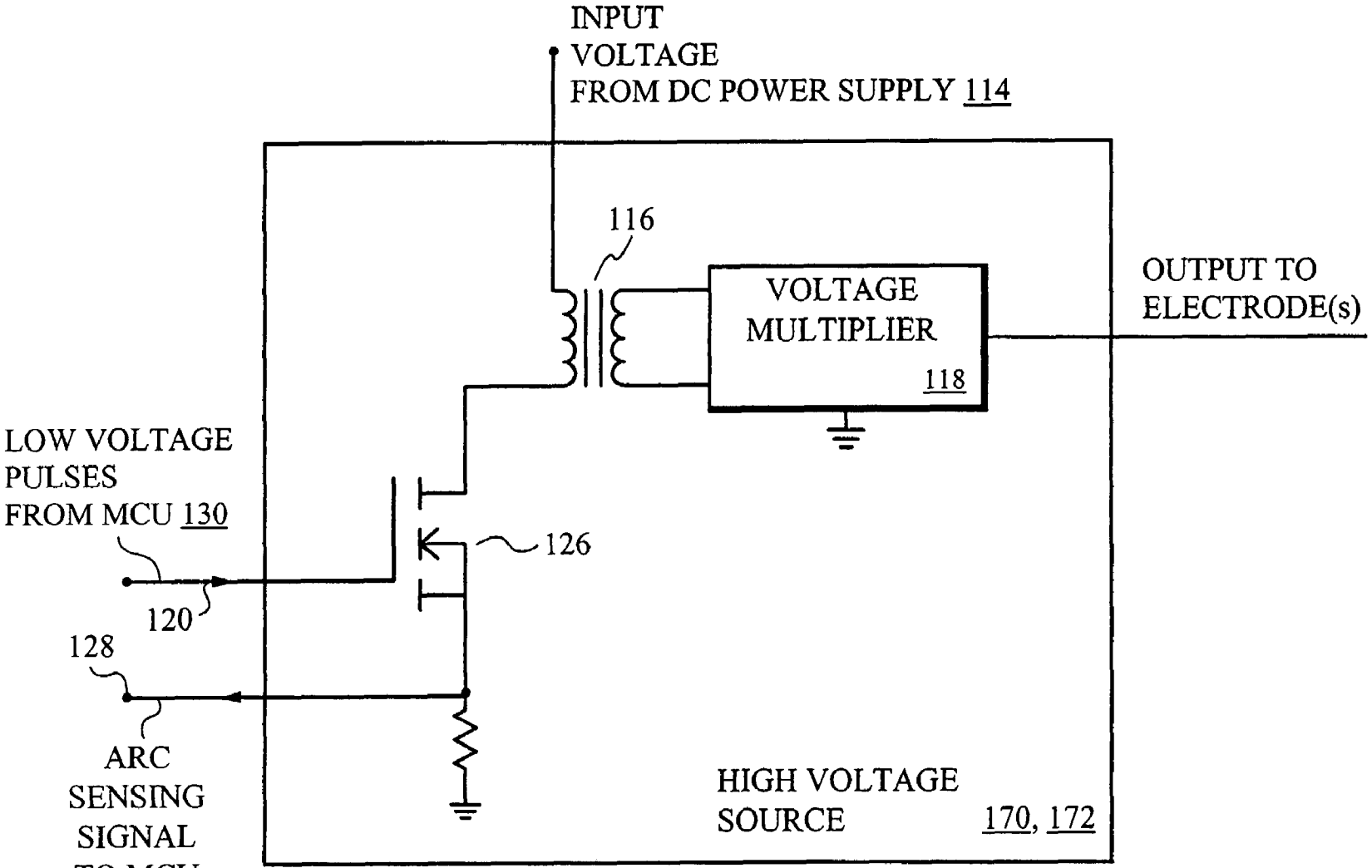
FIG. 5B illustrates an electrical block diagram of the high voltage power source in accordance with one embodiment of the present invention.

FIG. 5B illustrates a schematic block diagram of the high voltage power supply in accordance with one embodiment of the present invention. For the present description, the first and second HVSs 170, 172 include the same or similar components as that shown in FIG. 5B. However, it is apparent to one skilled in the art that the first and second HVSs 170, 172 are alternatively comprised of different components from each other as well as those shown in FIG. 5B.

In the embodiment shown in FIG. 5B, the HVSs 170, 172 include an electronic switch 126, a step-up transformer 116 and a voltage multiplier 118. The primary side of the step-up transformer 116 receives the DC voltage from the DC power supply 114. For the first HVS 170, the DC voltage received from the DC power supply 114 is approximately 160 Vdc. For the second HVS 172, the DC voltage received from the DC power supply 114 is approximately 12 Vdc. An electronic switch 126 receives low voltage pulses 120 (of perhaps 20-25 KHz frequency) from the MCU 130. Such a switch is shown as an insulated gate bipolar transistor (IGBT) 126. The IGBT 126, or other appropriate switch, couples the low voltage pulses 120 from the MCU 130 to the input winding of the step-up transformer 116. The secondary winding of the transformer 116 is coupled to the voltage multiplier 118, which outputs the high voltage pulses to the electrode(s). For the first HVS 170, the electrode(s) are the emitter and collector electrode sets 230 and 240. For the second HVS 172, the electrode(s) are the trailing electrodes 222. In general, the IGBT 126 operates as an electronic on/off switch. Such a transistor is well known in the art and does not require a further description.

When driven, the first and second HVSs 170, 172 receive the low input DC voltage from the DC power supply 114 and the low voltage pulses from the MCU 130 and generate high voltage pulses of preferably at least 5 KV peak-to-peak with a repetition rate of about 20 to 25 KHz. The voltage multiplier 118 in the first HVS 170 outputs between 5 to 9 KV to the first set of electrodes 230 and between −6 to −18 KV to the second set of electrodes 240. In the preferred embodiment, the emitter electrodes 232 receive approximately 5 to 6 KV whereas the collector electrodes 242 receive approximately −9 to −10 KV. The voltage multiplier 118 in the second HVS 172 outputs approximately −12 KV to the trailing electrodes 222. In one embodiment, the driver electrodes 246 are preferably connected to ground. It is within the scope of the present invention for the voltage multiplier 118 to produce greater or smaller voltages. The high voltage pulses preferably have a duty cycle of about 10%-15%, but may have other duty cycles, including a 100% duty cycle.

The MCU 130 is coupled to a control dial S1, as discussed above, which can be set to a LOW, MEDIUM or HIGH airflow setting as shown in FIG. 5A. The MCU 130 controls the amplitude, pulse width, duty cycle and/or frequency of the low voltage pulse signal to control the airflow output of the system 100, based on the setting of the control dial S1. To increase the airflow output, the MCU 130 can be set to increase the amplitude, pulse width, frequency and/or duty cycle. Conversely, to decrease the airflow output rate, the MCU 130 is able to reduce the amplitude, pulse width, frequency and/or duty cycle. In accordance with one embodiment, the low voltage pulse signal 120 has a fixed pulse width, frequency and duty cycle for the LOW setting, another fixed pulse width, frequency and duty cycle for the MEDIUM setting, and a further fixed pulse width, frequency and duty cycle for the HIGH setting.

In accordance with one embodiment of the present invention, the low voltage pulse signal 120 modulates between a predetermined duration of a "high" airflow signal and a "low" airflow signal. It is preferred that the low voltage signal modulates between a predetermined amount of time when the airflow is to be at the greater "high" flow rate, followed by another predetermined amount of time in which the airflow is to be at the lesser "low" flow rate. This is preferably executed by adjusting the voltages provided by the first HVS to the first and second sets of electrodes for the greater flow rate period and the lesser flow rate period. This produces an acceptable airflow output while limiting the ozone production to acceptable levels, regardless of whether the control dial S 1 is set to HIGH, MEDIUM or LOW. For example, the "high" airflow signal can have a pulse width of 5 microseconds and a period of 40 microseconds (i.e., a 12.5% duty cycle), and the "low" airflow signal can have a pulse width of 4 microseconds and a period of 40 microseconds (i.e., a 10% duty cycle).

In general, the voltage difference between the first set 230 and the second set 240 is proportional to the actual airflow output rate of the system 100. Thus, the greater voltage differential is created between the first and second set electrodes 230, 240 by the "high" airflow signal, whereas the lesser voltage differential is created between the first and second set electrodes 230, 240 by the "low" airflow signal. In one embodiment, the airflow signal causes the voltage multiplier 118 to provide between 5 and 9 KV to the first set electrodes 230 and between −9 and −10 KV to the second set electrodes 240. For example, the "high" airflow signal causes the voltage multiplier 118 to provide 5.9 KV to the first set electrodes 230 and −9.8 KV to the second set electrodes 240. In the example, the "low" airflow signal causes the voltage multiplier 118 to provide 5.3 KV to the first set electrodes 230 and −9.5 KV to the second set electrodes 240. It is within the scope of the present invention for the MCU 130 and the first HVS 170 to produce voltage potential differentials between the first and second sets electrodes 230 and 240 other than the values provided above and is in no way limited by the values specified.

In accordance with the preferred embodiment of the present invention, when the control dial S1 is set to HIGH, the electrical signal output from the MCU 130 will continuously drive the first HVS 170 and the airflow, whereby the electrical signal output modulates between the "high" and "low" airflow signals stated above (e.g. 2 seconds "high" and 10 seconds "low"). When the control dial S1 is set to MEDIUM, the electrical signal output from the MCU 130 will cyclically drive the first HVS 170 (i.e. airflow is "On") for a predetermined amount of time (e.g., 20 seconds), and then drop to a zero or a lower voltage for a further predetermined amount of time (e.g., a further 20 seconds). It is to be noted that the cyclical drive when the airflow is "On" is preferably modulated between the "high" and "low" airflow signals (e.g. 2 seconds "high" and 10 seconds "low"), as stated above. When the control dial S 1 is set to LOW, the signal from the MCU 130 will cyclically drive the first HVS 170 (i.e. airflow is "On") for a predetermined amount of time (e.g., 20 seconds), and then drop to a zero or a lower voltage for a longer time period (e.g., 80 seconds). Again, it is to be noted that the cyclical drive when the airflow is "On" is preferably modulated between the "high" and "low" airflow signals (e.g. 2 seconds "high" and 10 seconds "low"), as stated above. It is within the scope and spirit of the present invention the HIGH, MEDIUM, and LOW settings will drive the first HVS 170 for longer or shorter periods of time. It is also contemplated that the cyclic drive between "high" and "low" airflow signals are durations and voltages other than that described herein.

Cyclically driving airflow through the system 100 for a period of time, followed by little or no airflow for another period of time (i.e. MEDIUM and LOW settings) allows the overall airflow rate through the system 100 to be slower than when the dial S1 is set to HIGH. In addition, cyclical driving reduces the amount of ozone emitted by the system since little or no ions are produced during the period in which lesser or no airflow is being output by the system. Further, the duration in which little or no airflow is driven through the system 100 provides the air already inside the system a longer dwell time, thereby increasing particle collection efficiency. In one embodiment, the long dwell time allows air to be exposed to a germicidal lamp, if present.

Regarding the second HVS 172, approximately 12 volts DC is applied to the second HVS 172 from the DC Power Supply 114. The second HVS 172 provides a negative charge (e.g. −12 KV) to one or more trailing electrodes 222 in one embodiment. However, it is contemplated that the second HVS 172 provides a voltage in the range of, and including, −10 KV to −60 KV in other embodiments. In one embodiment, other voltages produced by the second HVS 172 are contemplated.

In one embodiment, the second HVS 172 is controllable independently from the first HVS 170 (as for example by the boost button 216) to allow the user to variably increase or decrease the amount of negative ions output by the trailing electrodes 222 without correspondingly increasing or decreasing the amount of voltage provided to the first and second set of electrodes 230, 240. The second HVS 172 thus provides freedom to operate the trailing electrodes 222 independently of the remainder of the electrode assembly 220 to reduce static electricity, eliminate odors and the like. In addition, the second HVS 172 allows the trailing electrodes 222 to operate at a different duty cycle, amplitude, pulse width, and/or frequency than the electrode sets 230 and 240. In one embodiment, the user is able to vary the voltage supplied by the second HVS 172 to the trailing electrodes 222 at any time by depressing the button 216. In one embodiment, the user is able to turn on or turn off the second HVS 172, and thus the trailing electrodes 222, without affecting operation of the electrode assembly 220 and/or the germicidal lamp 290. It should be noted that the second HVS 172 can also be used to control electrical components other than the trailing electrodes 222 (e.g. driver electrodes and germicidal lamp).

As mentioned above, the system 100 includes a boost button 216. In one embodiment, the trailing electrodes 222 as well as the electrode sets 230, 240 are controlled by the boost signal from the boost button 216 input into the MCU 130. In one embodiment, as mentioned above, the boost button 216 cycles through a set of operating settings upon the boost button 216 being depressed. In the example embodiment discussed below, the system 100 includes three operating settings. However, any number of operating settings are contemplated within the scope of the invention.

The following discussion presents methods of operation of the boost button 216 which are variations of the methods discussed above. In particular, the system 100 will operate in a first boost setting when the boost button 216 is pressed once. In the first boost setting, the MCU 130 drives the first HVS 170 as if the control dial S1 was set to the HIGH setting for a predetermined amount of time (e.g., 6 minutes), even if the control dial S1 is set to LOW or MEDIUM (in effect overriding the setting specified by the dial S1). The predetermined time period may be longer or shorter than 6 minutes. For example, the predetermined period can also preferably be 20 minutes if a higher cleaning setting for a longer period of time is desired. This will cause the system 100 to run at a maximum airflow rate for the predetermined boost time period. In one embodiment, the low voltage signal modulates between the "high" airflow signal and the "low" airflow signal for predetermined amount of times and voltages, as stated above, when operating in the first boost setting. In another embodiment, the low voltage signal does not modulate between the "high" and "low" airflow signals.

In the first boost setting, the MCU 130 will also operate the second HVS 172 to operate the trailing electrode 222 to generate ions, preferably negative, into the airflow. In one embodiment, the trailing electrode 222 will preferably repeatedly emit ions for one second and then terminate for five seconds for the entire predetermined boost time period. The increased amounts of ozone from the boost level will further reduce odors in the entering airflow as well as increase the particle capture rate of the system 100. At the end of the predetermined boost period, the system 100 will return to the airflow rate previously selected by the control dial S1. It should be noted that the on/off cycle at which the trailing electrodes 222 operate are not limited to the cycles and periods described above.

In the example, once the boost button 216 is pressed again, the system 100 operates in the second setting, which is an increased ion generation or "feel good" mode. In the second setting, the MCU 130 drives the first HVS 170 as if the control dial S1 was set to the LOW setting, even if the control dial S1 is set to HIGH or MEDIUM (in effect overriding the setting specified by the dial S1). Thus, the airflow is not continuous, but "On" and then at a lesser or zero airflow for a predetermined amount of time (e.g. 6 minutes). In addition, the MCU 130 will operate the second HVS 172 to operate the trailing electrode 222 to generate negative ions into the airflow. In one embodiment, the trailing electrode 222 will repeatedly emit ions for one second and then terminate for five seconds for the predetermined amount of time. It should be noted that the on/off cycle at which the trailing electrodes 222 operate are not limited to the cycles and periods described above.

In the example, upon the boost button 216 being pressed again, the MCU 130 will operate the system 100 in a third operating setting, which is a normal operating mode. In the third setting, the MCU 130 drives the first HVS 170 depending on the which setting the control dial S1 is set to (e.g. HIGH, MEDIUM or LOW). In addition, the MCU 130 will operate the second HVS 172 to operate the trailing electrode 222 to generate ions, preferably negative, into the airflow at a predetermined interval. In one embodiment, the trailing electrode 222 will repeatedly emit ions for one second and then terminate for nine seconds. In another embodiment, the trailing electrode 222 does not operate at all in this mode. The system 100 will continue to operate in the third setting by default until the boost button 216 is pressed. It should be noted that the on/off cycle at which the trailing electrodes 222 operate are not limited to the cycles and periods described above.

In one embodiment, the present system 100 operates in an automatic boost mode upon the system 100 being initially plugged into the wall and/or initially being turned on after being off for a predetermined amount of time. In particular, upon the system 100 being turned on, the MCU 130 automatically drives the first HVS 170 as if the control dial Si was set to the HIGH setting for a predetermined amount of time, as discussed above, even if the control dial S1 is set to LOW or MEDIUM, thereby causing the system 100 to run at a maximum airflow rate for the amount of time. In addition, the MCU 130 automatically operates the second HVS 172 to operate the trailing electrode 222 at a maximum ion emitting rate to generate ions, preferably negative, into the airflow for the same amount of time. This configuration allows the system 100 to effectively clean stale, pungent, and/or polluted air in a room which the system 100 has not been continuously operating in. This feature improves the air quality at a faster rate while emitting negative "feel good" ions to quickly eliminate any odor in the room. Once the system 100 has been operating in the first setting boost mode, the system 100 automatically adjusts the airflow rate and ion emitting rate to the third setting (i.e. normal operating mode). For example, in this initial plug-in or initial turn-on mode, the system can operate in the high setting for 20 minutes to enhance the removal of particulates and to more rapidly clean the air as well as deodorize the room.

In addition, the system 100 will include an indicator light which informs the user what mode the system 100 is operating in when the boost button 216 is depressed. In one embodiment, the indicator light is the same as the cleaning indicator light 219 discussed above. In another embodiment, the indicator light is a separate light from the indicator light 219. For example only, the indicator light will emit a blue light when the system 100 operates in the first setting. In addition, the indicator light will emit a green light when the system 100 operates in the second setting. In the example, the indicator light will not emit a light when the system 100 is operating in the third setting.

The MCU 130 provides various timing and maintenance features in one embodiment. For example, the MCU 130 can provide a cleaning reminder feature (e.g., a 2 week timing feature) that provides a reminder to clean the system 100 (e.g., by causing indicator light 219 to turn on amber, and/or by triggering an audible alarm that produces a buzzing or beeping noise). The MCU 130 can also provide arc sensing, suppression and indicator features, as well as the ability to shut down the first HVS 170 in the case of continued arcing. Details regarding arc sensing, suppression and indicator features are described in U.S. patent application Ser. No. 10/625,401 and now U.S. Pat. No. 6,984,987, which is incorporated by reference above.

Figure 8A:
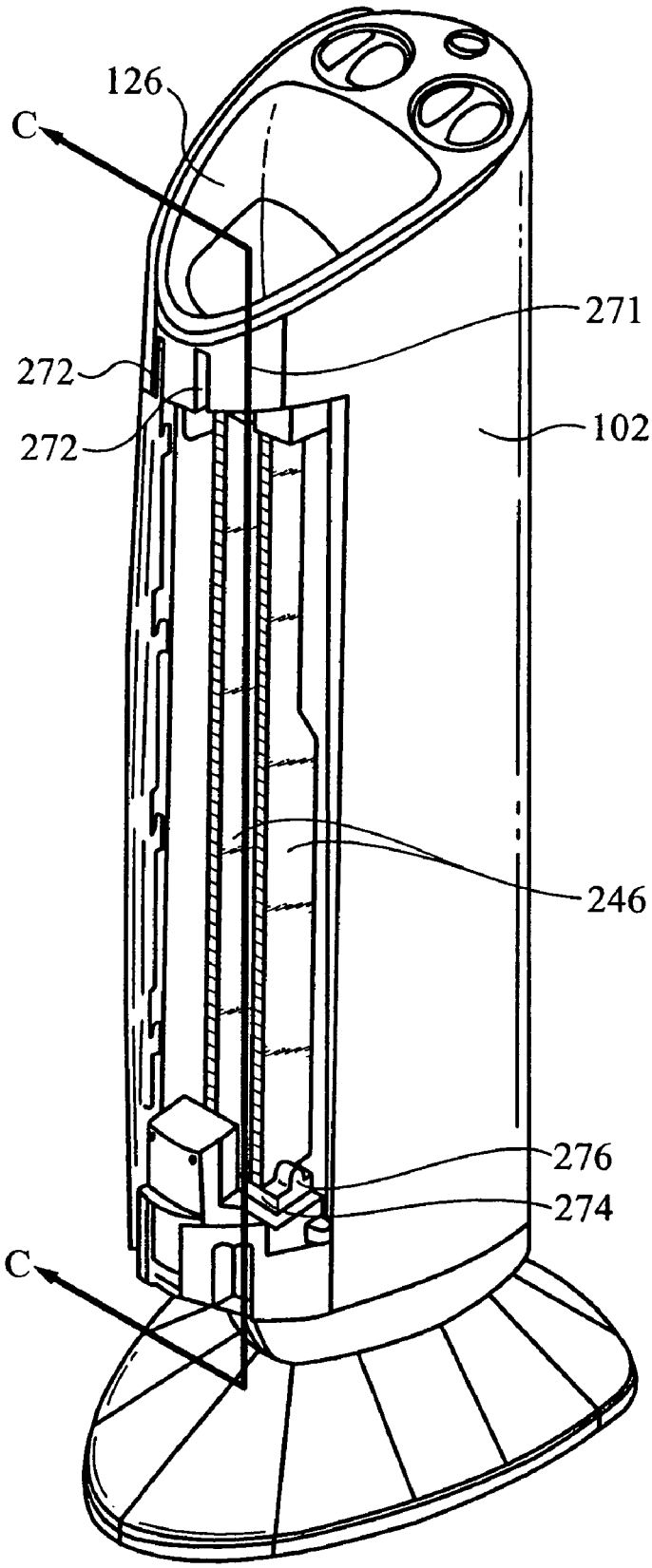
FIG. 8A illustrates a perspective view of the air-conditioner device with collector electrodes removed in accordance with one embodiment of the present invention.
Figure 8B:
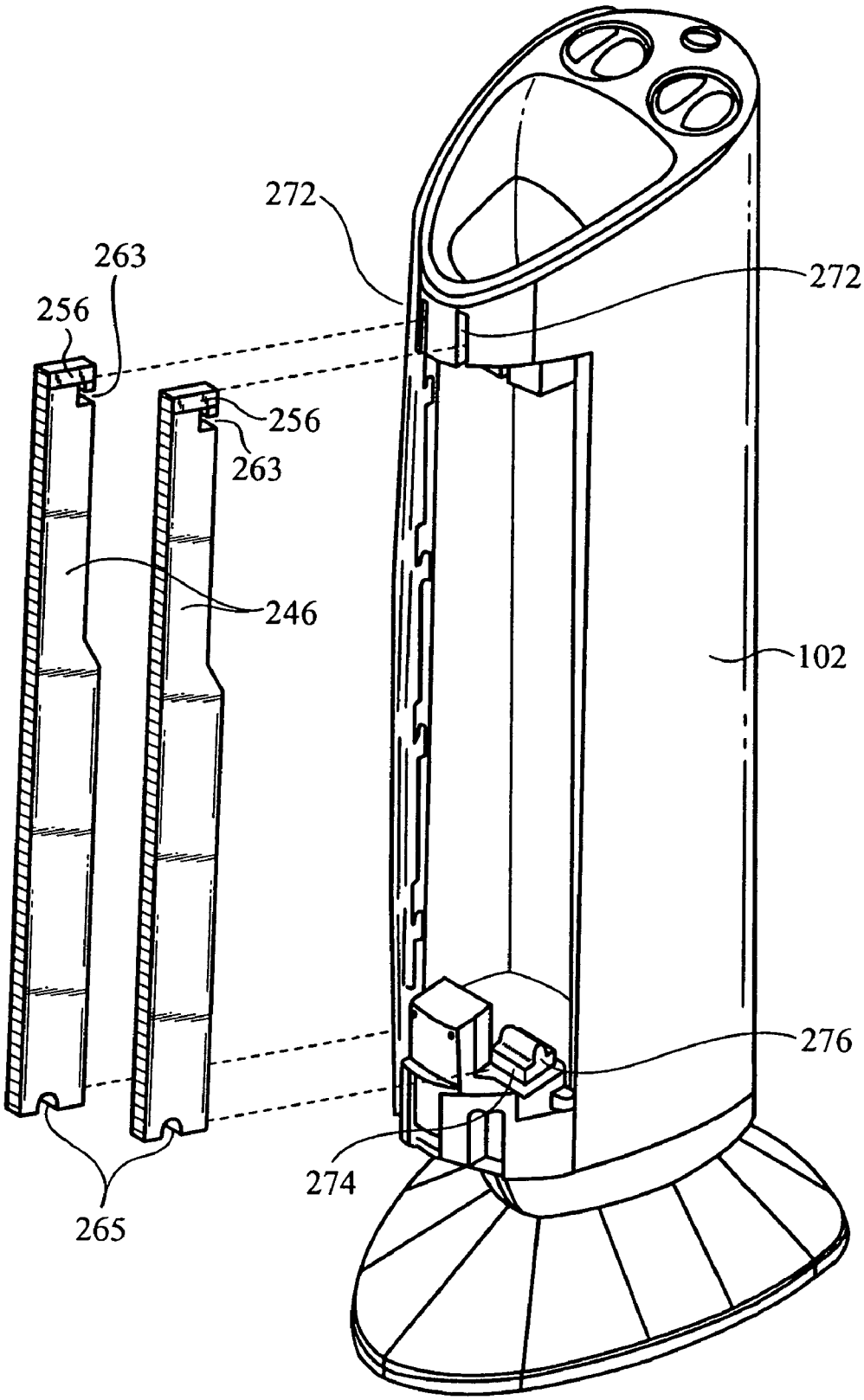
FIG. 8B illustrates an exploded view of the air-conditioner device with collector electrodes and driver electrodes removed in accordance with one embodiment of the present invention.

FIG. 6 illustrates an exploded view of the system 100 in accordance with one embodiment of the present invention. As shown in the embodiment in FIG. 6, the upper surface of housing 102 includes a user-liftable handle member 112 to lift the collector electrodes 242 from the housing 102. In the embodiment shown in FIG. 6, the lifting member 112 lifts the collector electrodes 242 upward, thereby causing the collector electrodes 242 to telescope out of the aperture 126 in the top surface 124 of the housing 102 and, and if desired, out of the system 100 for cleaning. In addition, the driver electrodes 246 are removable from the housing 102 horizontally, as shown in FIG. 8B. In one embodiment, the driver electrodes 246 are exposed within the housing 102 when the exhaust grill 106 is removed from the housing 102. In another embodiment, the driver electrodes 246 are exposed within the housing 102 when the inlet grill 104 and preferably the collector electrodes 242 are removed from the housing 102. When exposed within the housing 102, the driver electrodes 246 are removed in a lateral direction, whereby the driver electrodes 246 are removable independent of the collector electrodes 242.

In one embodiment, the collector electrodes 242 are lifted vertically out of the housing 102 while the emitter electrodes 232 (FIG. 3) remain in the system 100. In another embodiment, the entire electrode assembly 220 is configured to be lifted out of the system 100, whereby the first electrode set 230 and the second electrode set 240 are lifted together, or alternatively independent of one another. In FIG. 6, the top ends of the collector electrodes 242 are connected to a top mount 250, whereas the bottom ends of the collector electrodes 242 are connected to a bottom mount 252. In another embodiment, a mechanism is coupled to the bottom mount 252 which includes a flexible member and a slot for capturing and cleaning the emitter electrodes 232 whenever the collector electrodes 242 are moved vertically by the user. More detail regarding the cleaning mechanism is provided in the U.S. Pat. No. 6,709,484 which is incorporated by reference above.

As shown in FIG. 6, the inlet grill 104 as well as the exhaust grill 106 are removable from the system 100 to allow access to the interior of the system 100. The inlet grill 104 and the exhaust grill 106 are removable either partially or fully from the housing 102. In particular, as shown in the embodiment in FIG. 6, the exhaust grill 106 as well as the inlet grill 104 include several L-shaped coupling tabs 120 which secure the respective grills to the housing 102. The housing 102 includes a number of L-shaped receiving slots 122 which are positioned to correspondingly receive the L-shaped coupling tabs 120 of the respective grills. The inlet grill 104 and the exhaust grill 106 is alternatively removable from the housing 102 using alternative mechanisms. For instance, the grill 106 can be pivotably coupled to the housing 102, whereby the user is given access to the electrode assembly upon swinging open the grill 106.

Figure 7:
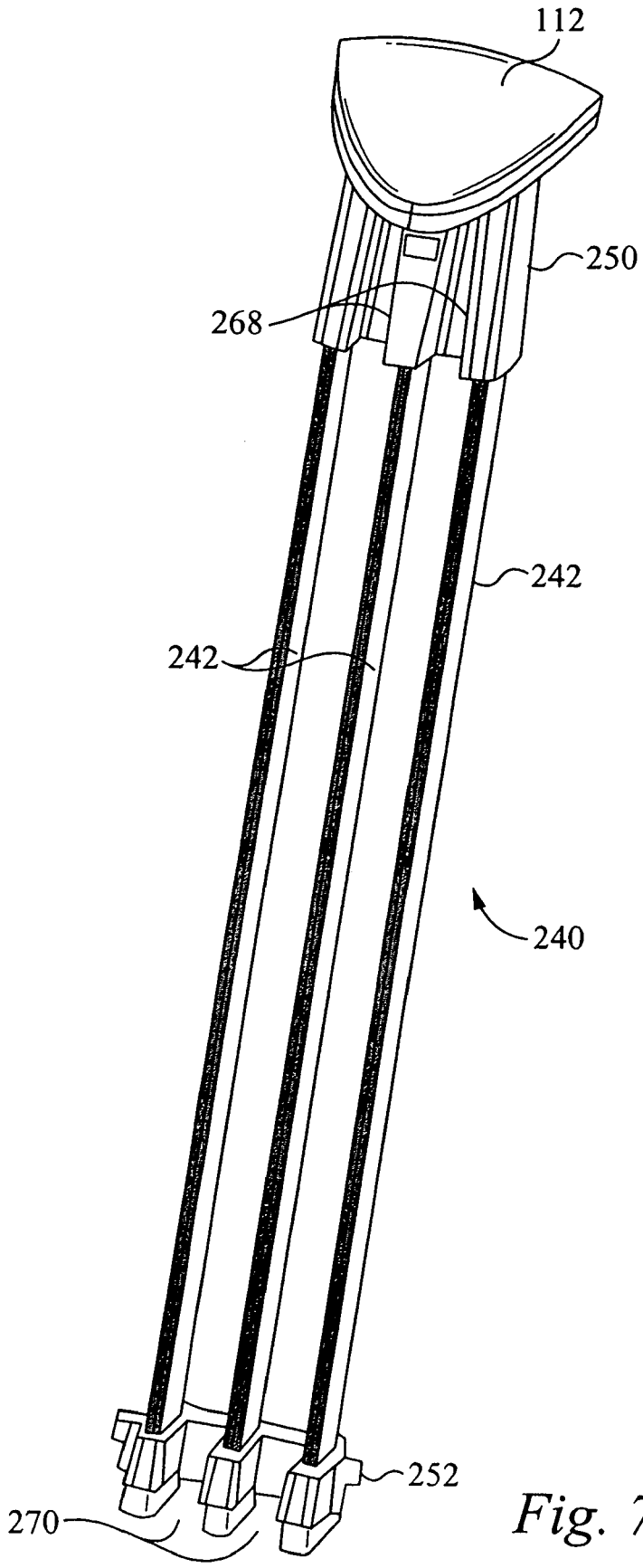
FIG. 7 illustrates a perspective view of the collector electrode assembly in accordance with one embodiment of the present invention.

FIG. 7 illustrates a perspective view of the collector electrode assembly 240 in accordance with one embodiment of the present invention. As shown in FIG. 7, the collector electrode assembly 240 includes the set of collector electrodes 242 coupled between the top mount 250 and the bottom mount 252. The top and bottom mounts 250, 252 preferably arrange the collector electrodes 242 in a fixed, parallel configuration. The liftable handle 112 is coupled to the top mount 250. The top and/or the bottom mounts 250, 252 include one or more contact terminals which electrically connect the collector electrodes 242 to the first high voltage source when the collector electrodes 242 are inserted in the housing 102. It is preferred that the contact terminals come out of contact with the corresponding terminals within the housing 102 when the collector electrodes 242 are removed from the housing 102.

In the embodiment shown in FIG. 7, three collector electrodes 242 are positioned between the top mount 250 and the bottom mount 252. However, any number of collector electrodes 242 are alternatively positioned between the top mount 250 and the bottom mount 252. As shown in FIG. 7, the top mount 250 includes a set of indents 268, and the bottom mount 252 also includes a set of indents 270. The indents 268, 270 in the top and bottom mounts 250, 252 allow the collector electrode assembly 240 and the driver electrodes 246 to be inserted and removed from the housing 102 without interfering or colliding with one another. As stated above, the driver electrodes 246 are positioned interstitially between adjacent collector electrodes 242 (FIG. 3). Thus, indents 268, 270 allow the collector electrodes 242 to be vertically inserted or removed from the housing 102 while the driver electrodes 246 remain positioned within the housing 102. Likewise, indents 268, 270 allow the driver electrodes 246 to be horizontally inserted or removed from the housing 102 while the collector electrodes 242 remain positioned within the housing 102. In summary, the driver electrodes 246 are inserted and removed from the housing 102 in a horizontal direction, whereas the collector electrodes 242 are preferably inserted and removed from the housing in a vertical direction. Further in summary, in the embodiment shown in FIG. 7, a driver electrode 246 would be positioned in each indented area 270 when the both, the driver electrodes 246 and the collector electrode assembly 240 is positioned in the housing 102.

Figure 8C:
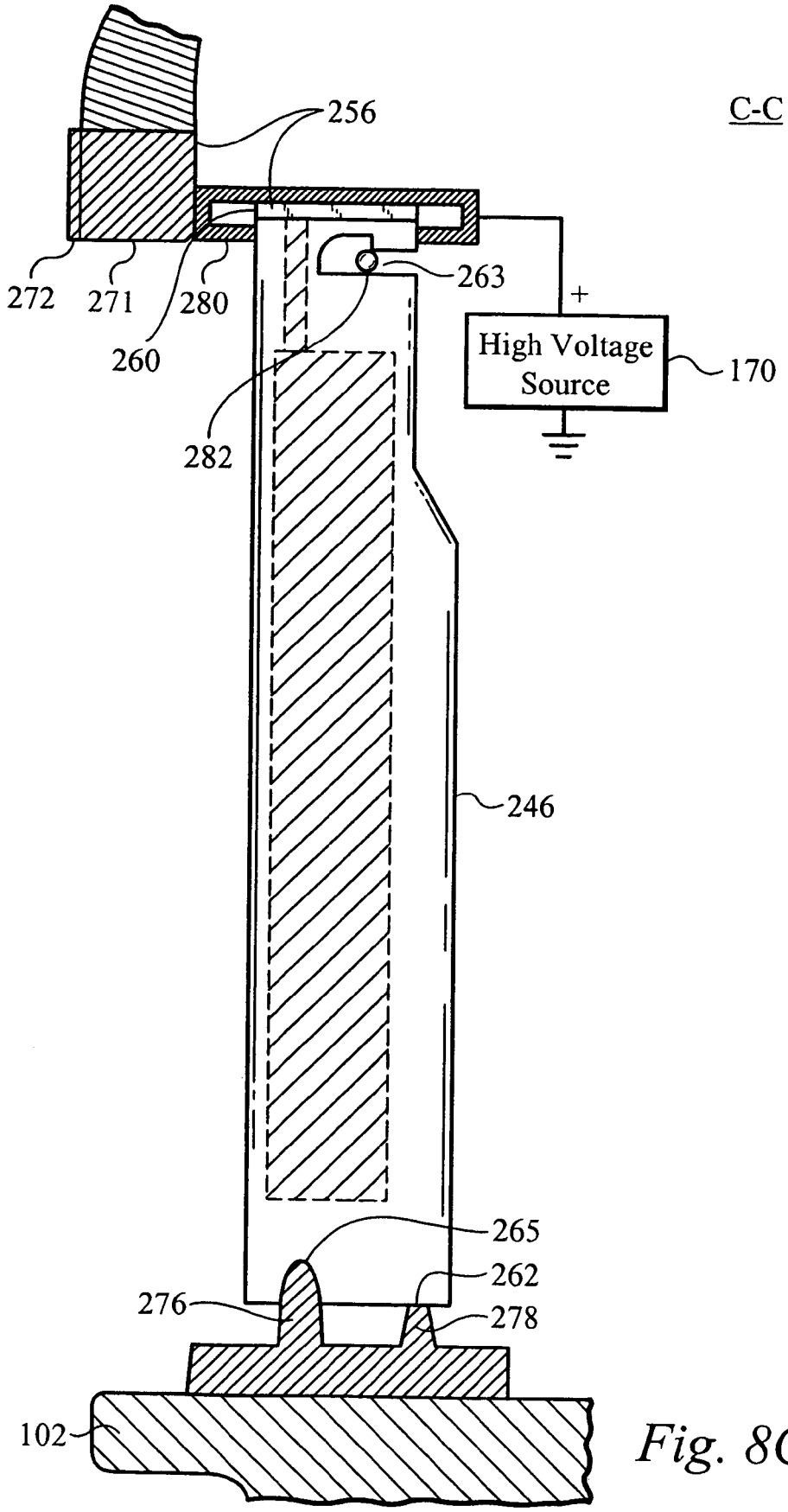
FIG. 8C illustrates a cross-sectional view of the air-conditioner device in FIG. 8A along line C-C in accordance with one embodiment of the present invention.

As desired, the driver electrodes 246 are preferably removable from the system 100. As shown in FIGS. 8A and 8B, within the housing 102 is a front section 271 near the top of the housing 102 having aperture guides 272 therethrough. The aperture guides 272 are in communication with engaging tracks 280 (FIG. 8C) within the housing 102, whereby the guides 272 allow the driver electrodes 246 to be properly inserted and removed from the engaging tracks 280 (FIG. 8C). It should be noted that although the driver electrodes 246 are shown to be insertable and removable from the front portion of the housing 102, as shown in FIG. 8B, the driver electrodes 246 are alternatively insertable and removable from the rear of the housing 102.

FIG. 8C illustrates a cross-sectional view of the air-conditioner device in FIG. 8A along line C-C in accordance with one embodiment of the present invention. As shown in FIG. 8C, the top end of each driver electrode 246 fits, preferably with a friction fit, in between the engaging tracks 280 proximal to the top end 260 and the protrusion 276 proximal to the bottom of the housing 102. In one embodiment, the engaging tracks 280 are electrically connected to the high voltage source 170. In another embodiment, the engaging tracks 280 are electrically connected to ground. The tracks 280 preferably include a terminal which comes into contact with the terminal 256 when the driver electrode 246 is secured within the housing 102. Thus, in one embodiment, when the driver electrodes 246 are coupled to the engagement tracks 280, voltage is able to be applied to the driver electrodes 246 from the high voltage source 170, if desired. In the preferred embodiment, the engaging tracks 280 provide an adequate ground connection with the driver electrodes 246 when the driver electrodes 246 are secured thereto.

In one embodiment, the driver electrodes 246 are inserted as well as removed from the housing 102 in a horizontal direction. In another embodiment, the driver electrode 246 is inserted into the housing 102 by first coupling the bottom end 262 to the housing and pivoting the driver electrode 246 about its bottom end 262 to couple the hook 263 to a securing rod 282 within the housing. In particular, the detent 265 in the bottom end 262 is mated with the protrusion 276 and the driver electrode 246 is able to pivot about the protrusion 276 until the securing rod 282 is secured within the securing area 263. When the driver electrode 246 is in the resting position, the protrusion 276 is engaged to the detent 265 and the secondary protrusion 278 is in contact with the bottom end 262. In addition, the top end 260 is engaged with the respective engagement track 280 in a friction fit, whereby the terminal 256 is electrically coupled to a voltage source or ground. The driver electrode 246 is thus secured within the securing area 263 and is not able to be inadvertently removed. Removal of the driver electrode 246 is performed in the reverse order. It should be noted that insertion and/or removal of the driver electrode 246 is not limited to the method described above. In addition, it is apparent that the driver electrode 246 is coupled to and removed from the housing 102 using other appropriate mechanisms and are not limited to the protrusion 276 and engagement tracks 280 discussed above. Thus, each driver electrode 246 is independently and individually removable and insertable with respect to one another as well as with respect to the exhaust grill 106 and collector electrodes 242. Therefore, the driver electrodes 246 will be exposed when the intake grill 104 and/or exhaust grill 106 are removed and can also be cleaned without needing to be removed from the housing 102. However, if desired, any one of the driver electrodes 246 is able to be removed while the collector electrodes 242 remain within the housing 102.

Figure 9:
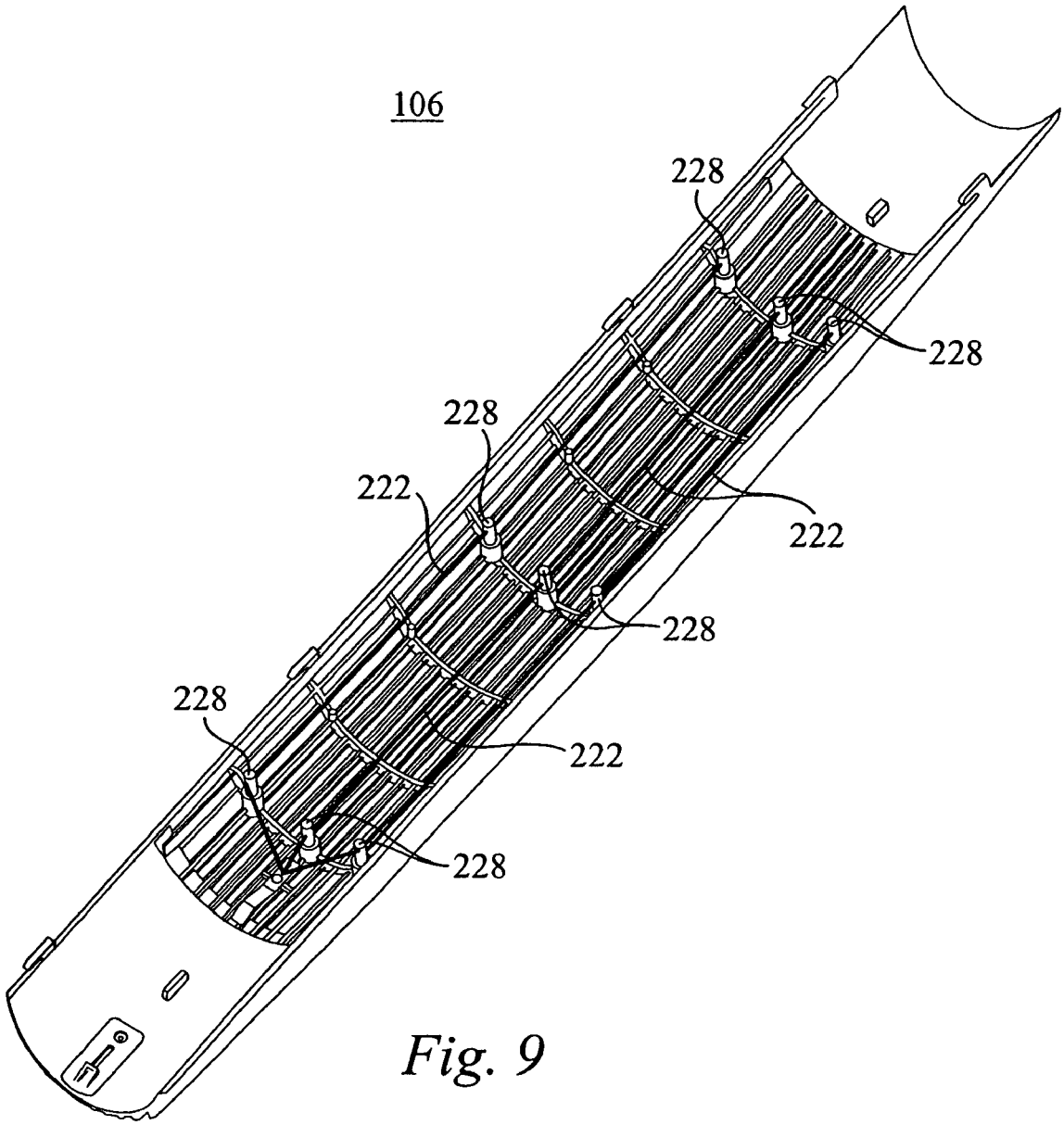
FIG. 9 illustrates a perspective view of the front grill with trailing electrodes thereon in accordance with one embodiment of the present invention.

FIG. 9 illustrates a perspective view of the front grill with trailing electrodes thereon in accordance with one embodiment of the present invention. As shown in FIG. 9, the trailing electrodes 222 are coupled to an inner surface of the exhaust grill 106. This arrangement allows the user to clean the trailing electrodes 222 from the housing 102 by simply removing the exhaust grill 106. Additionally, placement of the trailing electrodes 222 along the inner surface of the exhaust grill 106 allows the trailing electrodes 222 to emit ions directly out of the system 100 with the least amount of airflow resistance. More details regarding cleaning of the trailing electrodes 222 are described in U.S. Patent Application No. 60/590,735 which is incorporated by reference above.

The operation of cleaning the present system 100 will now be discussed. The exhaust grill 106 is first removed from the housing 102. This is done by lifting the exhaust grill 106 vertically and then pulling the grill 106 horizontally away from the housing 102. Additionally, the exhaust grill 106 is removable from the housing 102 in the same manner. In one embodiment, once the exhaust grill 106 is removed from the housing 102, the trailing electrodes 222 is exposed, and the user is able to clean the trailing electrodes 222 on the interior of the grill 106 (FIG. 9). In one embodiment, the user is able to clean the collector and driver electrodes 242, 246 while the electrodes 242, 246 are positioned within the housing 102. In another embodiment, the user is able to pull the collector electrodes 242 telescopically out through an aperture 126 in the top end 124 of the housing 106 as shown in FIG. 6 and have access to the driver electrodes 246.

The driver electrodes 246 are able to be cleaned while positioned within the housing or alternatively by removing the driver electrodes 246 laterally from the housing 102 (FIG. 8B). This is preferably done by slightly lifting the driver electrode 246 and pulling the driver electrode 246 along the engagement tracks 280 (FIG. 8C) out through the aperture guides 272 in the front section 271. In another embodiment, the driver electrodes 246 are removable via the back side of the housing 102 by first removing the inlet grill 104. Upon removing the driver electrodes 246, the user is able to clean the driver electrodes 246 by wiping them with a cloth. It should be noted that the driver electrodes 246 are removable from the housing 102 when the collector electrodes 242 are either present or removed from the housing 102. In addition, the driver electrodes 246 are individually removable or insertable into the housing 102.

Once the collector and driver electrodes 242, 246 are cleaned, the user then inserts the collector and driver electrodes 242, 246 back into the housing 102, in one embodiment. In one embodiment, this is done by moving the collector electrodes 242 vertically downwards through the aperture 126 in the top end 124 of the housing 102. Additionally, the driver electrodes 246 are horizontally inserted into the housing 102 as discussed above. The user is then able to couple the inlet grill 104 and the exhaust grill 106 to the housing 102 in an opposite manner from that discussed above. It is contemplated that the grills 104, 106 are alternatively coupled to the housing 102 before the collector electrodes 242 are inserted. Also, it is apparent to one skilled in the art that the electrode set 240 is able to be removed from the housing 102 while the inlet and/or exhaust grill 104, 106 remains coupled to the housing 102.

The foregoing description of the above embodiments of the present invention has been provided for the purposes of illustration and description. It is not intended to be exhaustive or to limit the invention to the precise forms disclosed. Many modifications and variations will be apparent to one of ordinary skill in the relevant arts. The embodiments were chosen and described in order to best explain the principles of the invention and its practical application, thereby enabling others skilled in the art to understand the invention for various embodiments and with various modifications that are suited to the particular use contemplated. It is intended that the scope of the invention be defined by the claims and their equivalence.

What is claimed is:

1. An air treatment apparatus comprising:

a. a housing;

b. a grill coupled to the housing;

c. an electrode assembly supported by the housing and configured to at least produce ions in a flow of air, wherein a portion of the electrode assembly is removable from the housing; and d. a driver electrode including a first driver electrode element and a second driver electrode element, the first driver electrode element being removable from the housing independent of:

(i) the removable portion of the electrode assembly; and (ii) the second driver electrode element.

2. The air treatment apparatus of claim 1, wherein the first and second driver electrode elements are removable through an opening formed through removal of the grill from the housing.

3. The air treatment apparatus of claim 1, wherein the electrode assembly further comprises:

a. an emitter electrode;

b. a collector electrode downstream of the emitter electrode; and c. a high voltage source operatively connected to at least one of the emitter electrode and the collector electrode.

4. The air treatment apparatus of claim 3, wherein the removable portion of the electrode assembly includes the collector electrode.

5. The air treatment apparatus of claim 3, wherein the collector electrode further includes a plurality of spaced apart collector electrode elements and at least one of the first and second driver electrode elements is located between a plurality of the collector electrode elements.

6. The air treatment apparatus of claim 4, wherein the first and second driver electrode elements are removable independent of the collector electrode.

7. The air treatment apparatus of claim 3, wherein the housing is vertically elongated and includes an upper portion, wherein the collector electrode is configured to be removable from the housing through an aperture in the upper portion.

8. The air treatment apparatus of claim 3, wherein the housing is vertically elongated and includes an upper portion, wherein the collector electrode is configured to be removable from the housing through an aperture in the upper portion and the first and second driver electrode elements are removable through a side portion.

9. The air treatment apparatus of claim 1, wherein at least one of the first and second driver electrode elements is insulated.

10. The air treatment apparatus of claim 9, wherein the insulated driver electrode element is coated with an ozone reducing catalyst.

11. The air treatment apparatus of claim 9, wherein at least one of the insulated driver electrode elements includes an electrically conductive electrode covered by a dielectric material.

12. The air treatment apparatus of claim 11, wherein the dielectric material is coated with an ozone reducing catalyst.

13. The air treatment apparatus of claim 11, wherein the dielectric material further comprises a non-electrically conductive ozone reducing catalyst.

14. The air treatment apparatus of claim 1, wherein at least one of the first and second driver electrode elements is plate shaped.

15. The air treatment apparatus of claim 1, wherein at least one of the first and second driver electrode elements is grounded.

16. The air treatment apparatus of claim 3, wherein the collector electrode has a leading portion and a trailing portion, the collector electrode positioned within the housing such that the trailing portion is positioned distal to the emitter electrode, wherein at least one of the first and second driver electrode elements is positioned proximal to the trailing portion.

17. The air treatment apparatus of claim 3, wherein the high voltage source further comprises a first voltage generator coupled to the at least one of the emitter electrode and the collector electrode, wherein the first voltage generator creates a flow of air downstream from the emitter electrode to the collector electrode.

18. The air treatment apparatus of claim 3, further comprising a trailing electrode downstream of the collector electrode.

19. The air treatment apparatus of claim 18, further comprising:

a first voltage generator coupled to the at least one of the emitter electrode and the collector electrode, wherein the first voltage generator creates a flow of air downstream from the emitter electrode to the collector electrode; and a second voltage generator coupled to the trailing electrode, wherein the second high voltage source operates independently of the first voltage generator.

20. The air treatment apparatus of claim 3, wherein the emitter electrode is positively charged and the collector.

21. An air treatment apparatus comprising:

a housing;

an air inlet supported by the housing;

an air outlet supported by the housing;

an emitter electrode device supported by the housing;

a collector electrode device removably supported by the housing, the collector electrode device having a plurality of spaced-apart electrodes;

at least one additional electrode device including first and second electrodes configured to be removable from the housing independent of one another, each one of the first and second electrodes being:

(a) positioned between a plurality of the electrodes of the collector electrode device; and (b) removable from the housing independent of the removal of the collector electrode device; and a voltage source operatively coupled to the emitter electrode device, the collector electrode device and the additional electrode device.

22. The air treatment apparatus of claim 21, wherein a portion of the collector electrode device is positioned downstream of a portion of the emitter electrode device.

23. The air treatment apparatus of claim 22, wherein the additional electrode device is operable to increase air flow through the housing or collect airborne particles.

* * * * *